US009432782B2

(12) United States Patent
Gustafsson et al.

(10) Patent No.: US 9,432,782 B2
(45) Date of Patent: Aug. 30, 2016

(54) ELECTROMAGNETIC TRANSDUCER WITH AIR GAP SUBSTITUTE

(71) Applicant: Cochlear Limited, Macquarie University, NSW (AU)

(72) Inventors: Johan Gustafsson, Göteborg (SE); Tommy Bergs, Härryda kommun (SE)

(73) Assignee: Cochlear Limited, Macquarie University, NSW (AU)

( * ) Notice: Subject to any disclaimer, the term of this patent is extended or adjusted under 35 U.S.C. 154(b) by 196 days.

(21) Appl. No.: 13/827,869

(22) Filed: Mar. 14, 2013

(65) Prior Publication Data

US 2014/0270297 A1 Sep. 18, 2014

(51) Int. Cl.

| | |
|---|---|
| ***H04R 25/00*** | (2006.01) |
| *H04R 9/02* | (2006.01) |
| *H04R 9/04* | (2006.01) |
| *H04R 11/02* | (2006.01) |

(52) U.S. Cl.

CPC ..... *H04R 25/606* (2013.01); *H04R 9/025* (2013.01); *H04R 9/046* (2013.01); *H04R 11/02* (2013.01); *H04R 25/60* (2013.01); *H04R 25/604* (2013.01); *H04R 2209/022* (2013.01); *H04R 2460/13* (2013.01)

(58) Field of Classification Search

USPC ..... 381/326, 322, 324

See application file for complete search history.

(56) References Cited

U.S. PATENT DOCUMENTS

| | | | | |
|---|---|---|---|---|
| 5,338,287 | A | 8/1994 | Miller et al. | |
| 6,751,334 | B2 | 6/2004 | Hakansson | |
| 6,985,599 | B2 | 1/2006 | Asnes | |
| 7,319,771 | B2 * | 1/2008 | Åsnes | H04R 25/606 381/322 |
| 2003/0034705 | A1 * | 2/2003 | Hakansson | H04R 9/025 310/81 |
| 2004/0057588 | A1 | 3/2004 | Asnes | |
| 2005/0135651 | A1 * | 6/2005 | Hakansson | H04R 9/025 381/396 |
| 2006/0045298 | A1 * | 3/2006 | Westerkull | H02K 33/18 381/326 |
| 2006/0208600 | A1 | 9/2006 | Sahyoun | |
| 2010/0145135 | A1 | 6/2010 | Ball et al. | |
| 2012/0237067 | A1 * | 9/2012 | Asnes | H04R 9/025 381/326 |

FOREIGN PATENT DOCUMENTS

WO 01/67813 A1 9/2001

* cited by examiner

*Primary Examiner* — Amir Etesam

(74) *Attorney, Agent, or Firm* — Hauptman Ham, LLP

(57) ABSTRACT

A balanced electromagnetic transducer, including first and second components connected together by a flexible component, at least a part of which flexes upon exposure of the transducer to energy, wherein the transducer is configured to generate a static magnetic flux that passes from the first component to the second component via the flexible component and travels across no more than two air gaps.

20 Claims, 17 Drawing Sheets

ELECTROMAGNETIC TRANSDUCER WITH AIR GAP SUBSTITUTE

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc, or for individuals who suffer from stuttering problems.

SUMMARY

In accordance with one aspect, there is a balanced electromagnetic transducer, comprising first and second components connected together by a flexible component, at least a part of which flexes upon exposure of the transducer to energy, wherein the transducer is configured to generate a static magnetic flux that passes from the first component to the second component via the flexible component and travels across no more than two air gaps.

In accordance with another aspect, there is a device, comprising an electromagnetic transducer configured in at least one of a balanced or an unbalanced configuration, wherein only one air gap is present in an unbalanced configuration, and only two air gaps are present in a balanced configuration.

In accordance with another aspect, there is a method of transducing energy, comprising moving a first assembly relative to a second assembly in an oscillatory manner, wherein during the movement, there is interaction of a dynamic magnetic flux and a static magnetic flux, and directing the static magnetic flux along a closed circuit that in totality extends across one or more air gaps, all of the one or more air gaps having respective widths that vary while the static magnetic flux is so directed and interacting with the dynamic magnetic flux, wherein if more than one air gap is present in the closed circuit, a rate of change of variation of width of one of the air gaps of the closed circuit is different from that of at least one of the other air gaps of the closed circuit.

BRIEF DESCRIPTION OF THE DRAWINGS

Some embodiments are described below with reference to the attached drawings, in which.

DETAILED DESCRIPTION

Figure 1A:
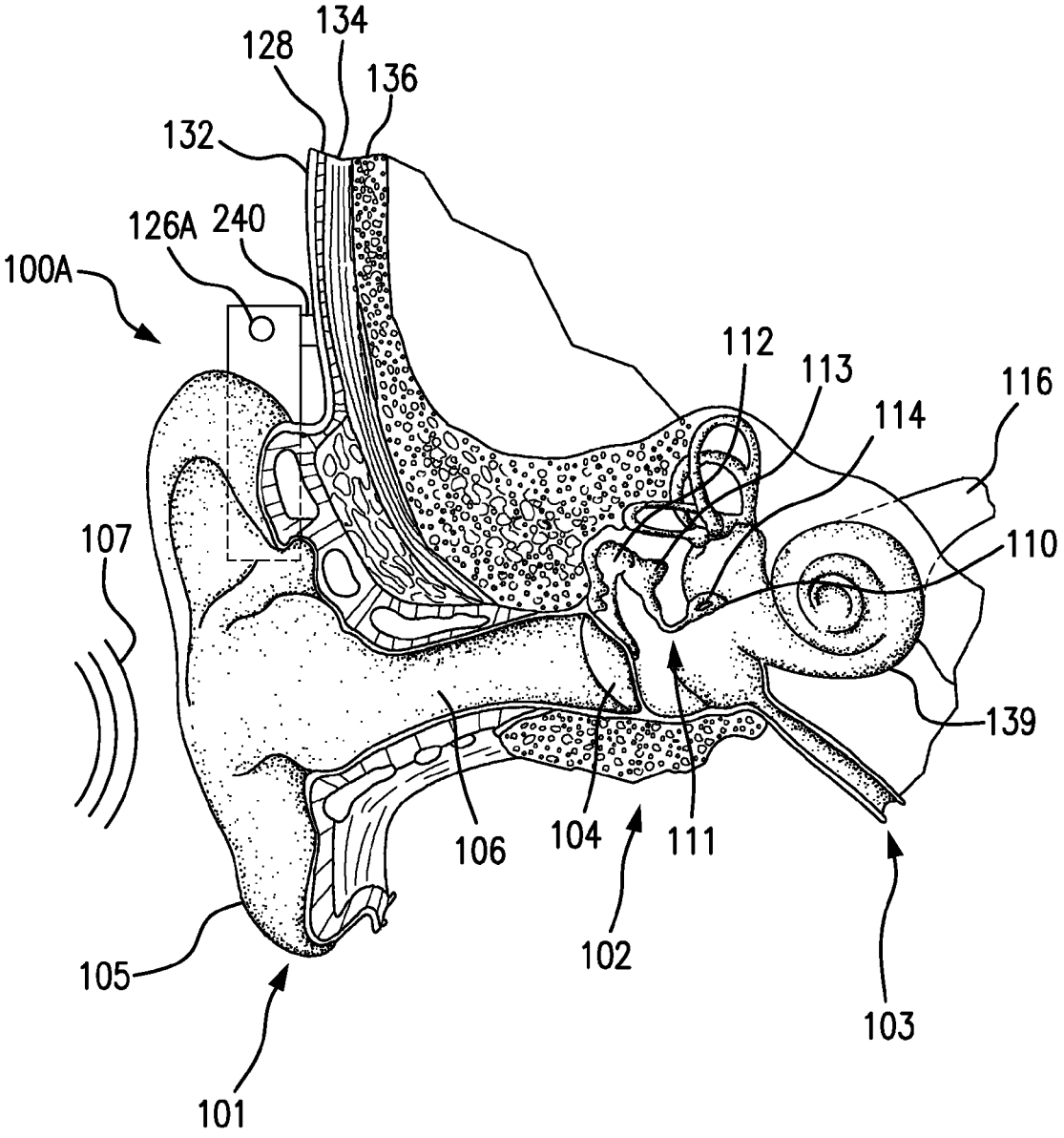
FIG. 1A is a perspective view of an exemplary bone conduction device in which at least some embodiments can be implemented.

FIG. 1A is a perspective view of a bone conduction device 100A in which embodiments may be implemented. As shown, the recipient has an outer ear 101, a middle ear 102 and an inner ear 103. Elements of outer ear 101, middle ear 102 and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1A also illustrates the positioning of bone conduction device 100A relative to outer ear 101, middle ear 102 and inner ear 103 of a recipient of device 100. As shown, bone conduction device 100 is positioned behind outer ear 101 of the recipient and comprises a sound input element 126A to receive sound signals. Sound input element may comprise, for example, a microphone, telecoil, etc. In an exemplary embodiment, sound input element 126A may be located, for example, on or in bone conduction device 100A, or on a cable extending from bone conduction device 100A.

In an exemplary embodiment, bone conduction device 100A comprises an operationally removable component and a bone conduction implant. The operationally removable component is operationally releasably coupled to the bone conduction implant. By operationally releasably coupled, it is meant that it is releasable in such a manner that the recipient can relatively easily attach and remove the operationally removable component during normal use of the bone conduction device 100A. Such releasable coupling is accomplished via a coupling assembly of the operationally removable component and a corresponding mating apparatus of the bone conduction implant, as will be detailed below. This as contrasted with how the bone conduction implant is attached to the skull, as will also be detailed below. The operationally removable component includes a sound processor (not shown), a vibrating electromagnetic actuator and/or a vibrating piezoelectric actuator and/or other type of actuator (not shown—which are sometimes referred to herein as a species of the genus vibrator) and/or various other operational components, such as sound input device 126A. In this regard, the operationally removable component is sometimes referred to herein as a vibrator unit. More particularly, sound input device 126A (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

As illustrated, the operationally removable component of the bone conduction device 100A further includes a coupling assembly 240 configured to operationally removably attach the operationally removable component to a bone conduction implant (also referred to as an anchor system and/or a fixation system) which is implanted in the recipient. In the embodiment of FIG. 1, coupling assembly 240 is coupled to the bone conduction implant (not shown) implanted in the recipient in a manner that is further detailed below with respect to exemplary embodiments of the bone conduction implant. Briefly, an exemplary bone conduction implant may include a percutaneous abutment attached to a bone fixture via a screw, the bone fixture being fixed to the recipient's skull bone 136. The abutment extends from the bone fixture which is screwed into bone 136, through muscle 134, fat 128 and skin 232 so that the coupling assembly may be attached thereto. Such a percutaneous abutment provides an attachment location for the coupling assembly that facilitates efficient transmission of mechanical force.

It is noted that while many of the details of the embodiments presented herein are described with respect to a percutaneous bone conduction device, some or all of the teachings disclosed herein may be utilized in transcutaneous bone conduction devices and/or other devices that utilize a vibrating electromagnetic actuator. For example, embodiments include active transcutaneous bone conduction systems utilizing the electromagnetic actuators disclosed herein and variations thereof where at least one active component (e.g. the electromagnetic actuator) is implanted beneath the skin. Embodiments also include passive transcutaneous bone conduction systems utilizing the electromagnetic actuators disclosed herein and variations thereof where no active component (e.g., the electromagnetic actuator) is implanted beneath the skin (it is instead located in an external device), and the implantable part is, for instance a magnetic pressure plate. Some embodiments of the passive transcutaneous bone conduction systems are configured for use where the vibrator (located in an external device) containing the electromagnetic actuator is held in place by pressing the vibrator against the skin of the recipient. In an exemplary embodiment, an implantable holding assembly is implanted in the recipient that is configured to press the bone conduction device against the skin of the recipient. In other embodiments, the vibrator is held against the skin via a magnetic coupling (magnetic material and/or magnets being implanted in the recipient and the vibrator having a magnet and/or magnetic material to complete the magnetic circuit, thereby coupling the vibrator to the recipient).

Figure 1B:
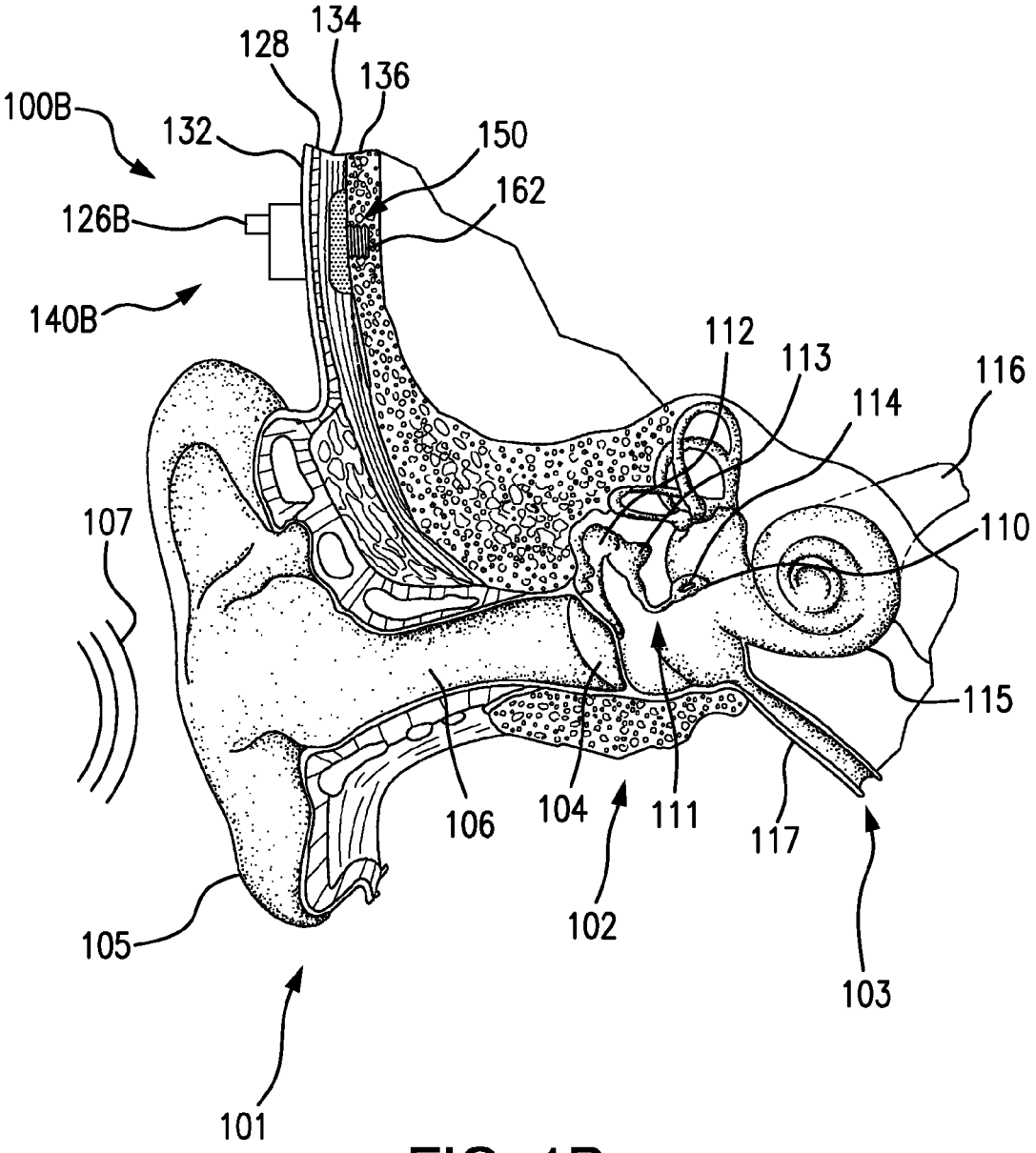
FIG. 1B is a perspective view of an alternate exemplary bone conduction device in which at least some embodiments can be implemented.

More specifically, FIG. 1B is a perspective view of a transcutaneous bone conduction device 100B in which embodiments can be implemented.

FIG. 1A also illustrates the positioning of bone conduction device 100B relative to outer ear 101, middle ear 102 and inner ear 103 of a recipient of device 100. As shown, bone conduction device 100 is positioned behind outer ear 101 of the recipient. Bone conduction device 100B comprises an external component 140B and implantable component 150. The bone conduction device 100B includes a sound input element 126B to receive sound signals. As with sound input element 126A, sound input element 126B may comprise, for example, a microphone, telecoil, etc. In an exemplary embodiment, sound input element 126B may be located, for example, on or in bone conduction device 100B, on a cable or tube extending from bone conduction device 100B, etc. Alternatively, sound input element 126B may be subcutaneously implanted in the recipient, or positioned in the recipient's ear. Sound input element 126B may also be a component that receives an electronic signal indicative of sound, such as, for example, from an external audio device. For example, sound input element 126B may receive a sound signal in the form of an electrical signal from an MP3 player electronically connected to sound input element 126B.

Bone conduction device 100B comprises a sound processor (not shown), an actuator (also not shown) and/or various other operational components. In operation, sound input device 126B converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B is a passive transcutaneous bone conduction device. That is, no active components, such as the actuator, are implanted beneath the recipient's skin 132. In such an arrangement, the active actuator is located in external component 140B, and implantable component 150 includes a magnetic plate, as will be discussed in greater detail below. The magnetic plate of the implantable component 150 vibrates in response to vibration transmitted through the skin, mechanically and/or via a magnetic field, that are generated by an external magnetic plate.

In another arrangement of FIG. 1B, bone conduction device 100B is an active transcutaneous bone conduction device where at least one active component, such as the actuator, is implanted beneath the recipient's skin 132 and is thus part of the implantable component 150. As described below, in such an arrangement, external component 140B may comprise a sound processor and transmitter, while implantable component 150 may comprise a signal receiver and/or various other electronic circuits/devices.

Figure 2:
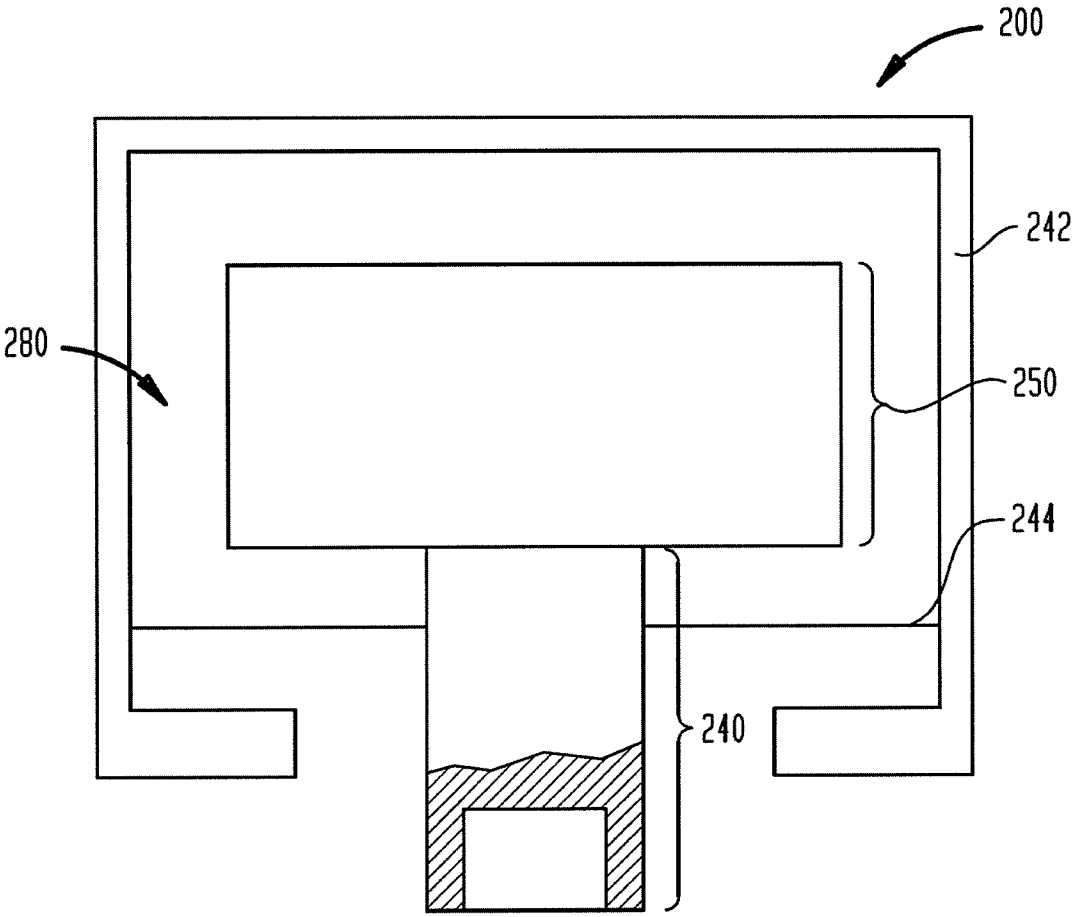
FIG. 2 is a schematic diagram conceptually illustrating a removable component of a percutaneous bone conduction device in accordance with at least some exemplary embodiments.

FIG. 2 is an embodiment of a bone conduction device 200 in accordance with an embodiment corresponding to that of FIG. 1A, illustrating use of a percutaneous bone conduction device. Bone conduction device 200, corresponding to, for example, element 100A of FIG. 1A, includes a housing 242, a vibrating electromagnetic actuator 250, a coupling assembly 240 that extends from housing 242 and is mechanically linked to vibrating electromagnetic actuator 250. Collectively, vibrating electromagnetic actuator 250 and coupling assembly 240 form a vibrating actuator-coupling assembly 280. Vibrating actuator-coupling assembly 280 is suspended in housing 242 by spring 244. In an exemplary embodiment, spring 244 is connected to coupling assembly 240, and vibrating electromagnetic actuator 250 is supported by coupling assembly 240.

Figure 3:
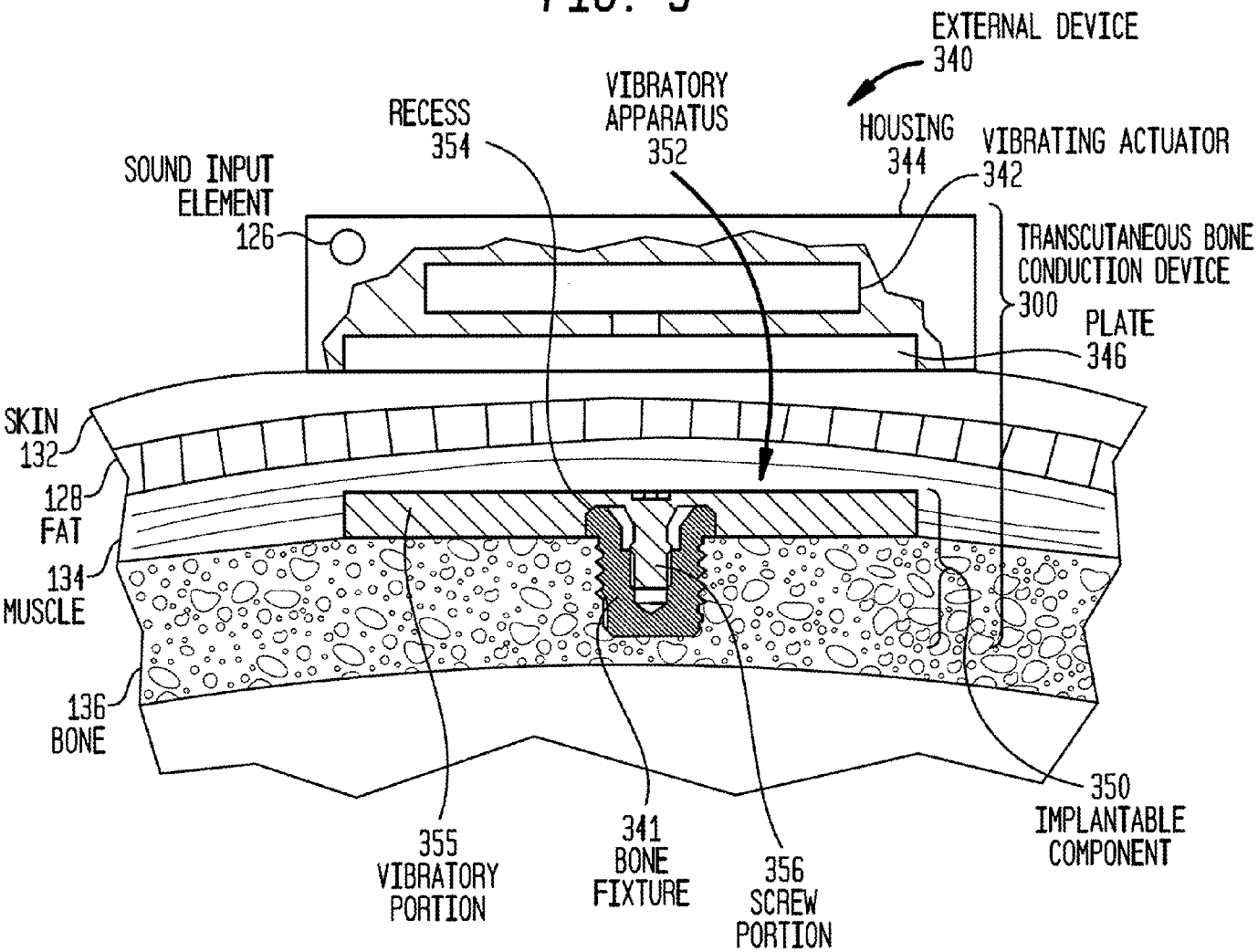
FIG. 3 is a schematic diagram conceptually illustrating a passive transcutaneous bone conduction device in accordance with at least some exemplary embodiments.

FIG. 3 depicts an exemplary embodiment of a transcutaneous bone conduction device 300 according to an embodiment that includes an external device 340 (corresponding to, for example, element 140B of FIG. 1B) and an implantable component 350 (corresponding to, for example, element 150 of FIG. 1B). The transcutaneous bone conduction device 300 of FIG. 3 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object such as an abutment as detailed herein with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 4:
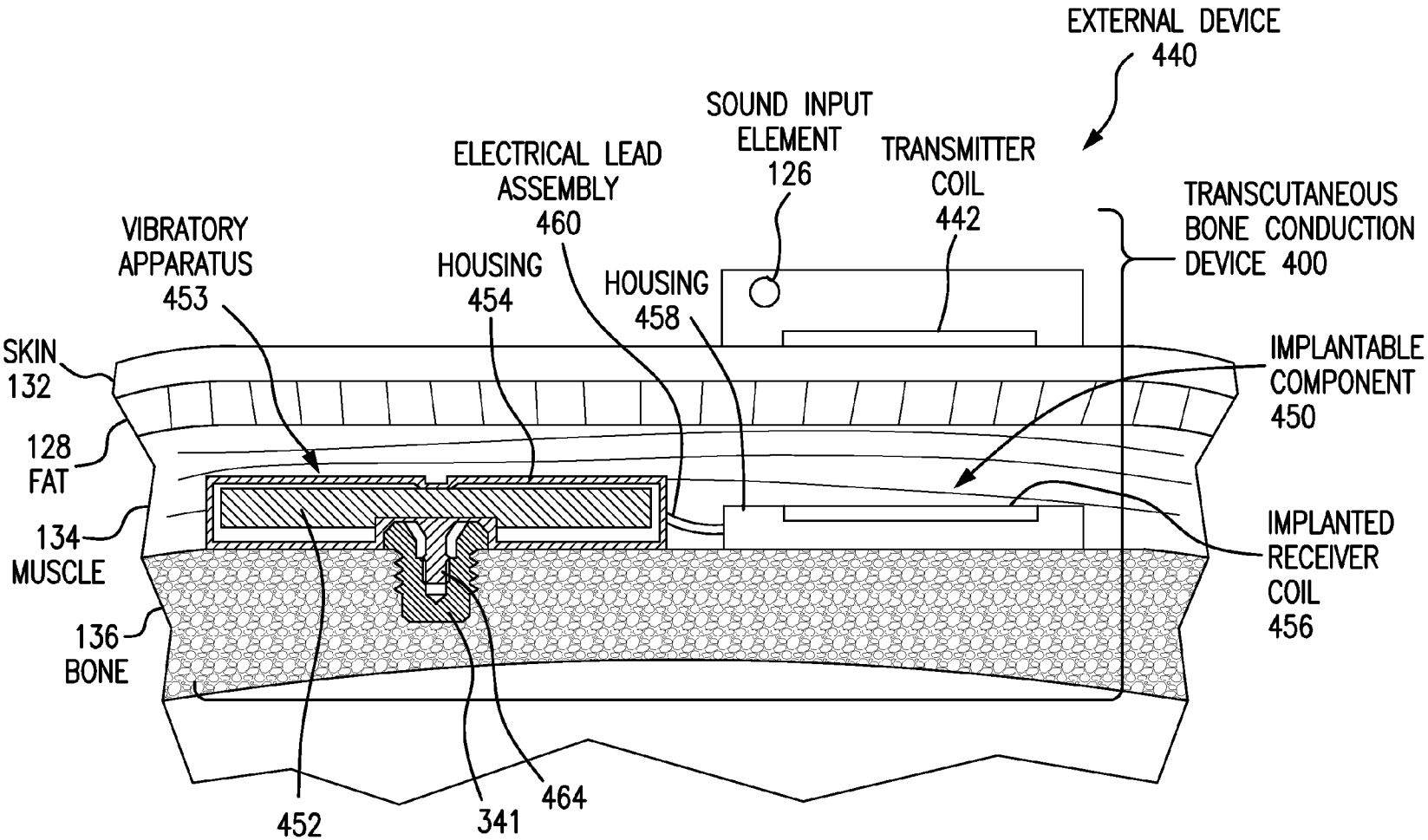
FIG. 4 is a schematic diagram conceptually illustrating an active transcutaneous bone conduction device in accordance with at least some exemplary embodiments.

FIG. 4 depicts an exemplary embodiment of a transcutaneous bone conduction device 400 according to another embodiment that includes an external device 440 (corresponding to, for example, element 140B of FIG. 1B) and an implantable component 450 (corresponding to, for example, element 150 of FIG. 1B). The transcutaneous bone conduction device 400 of FIG. 4 is an active transcutaneous bone conduction device in that the vibrating actuator 452 is located in the implantable component 450. Specifically, a vibratory element in the form of vibrating actuator 452 is located in housing 454 of the implantable component 450. In an exemplary embodiment, much like the vibrating actuator 342 described above with respect to transcutaneous bone conduction device 300, the vibrating actuator 452 is a device that converts electrical signals into vibration.

External component 440 includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating actuator 452 via electrical lead assembly 460. The vibrating electromagnetic actuator 452 converts the electrical signals into vibrations.

The vibrating electromagnetic actuator 452 is mechanically coupled to the housing 454. Housing 454 and vibrating actuator 452 collectively form a vibrating element 453. The housing 454 is substantially rigidly attached to bone fixture 341.

Some exemplary features of the vibrating electromagnetic actuator usable in some embodiments of the bone conduction devices detailed herein and/or variations thereof will now be described in terms of a vibrating electromagnetic actuator used in the context of the percutaneous bone conduction device of FIG. 1A. It is noted that any and/or all of these features and/or variations thereof may be utilized in transcutaneous bone conduction devices such as those of FIGS. 1B, 3 and 4 and/or other types of prostheses and/or medical devices and/or other devices, at least with respect to enabling utilitarian performance thereof. It is also noted that while the embodiments detailed herein are detailed with respect to an electromagnetic actuator, the teachings associated therewith are equally applicable to electromagnetic transducers that receive vibrations and output a signal indicative of the vibrations, at least unless otherwise noted. In this regard, it is noted that use of the term actuator herein also corresponds to transducer, and vice-versa, unless otherwise noted.

Figure 5:
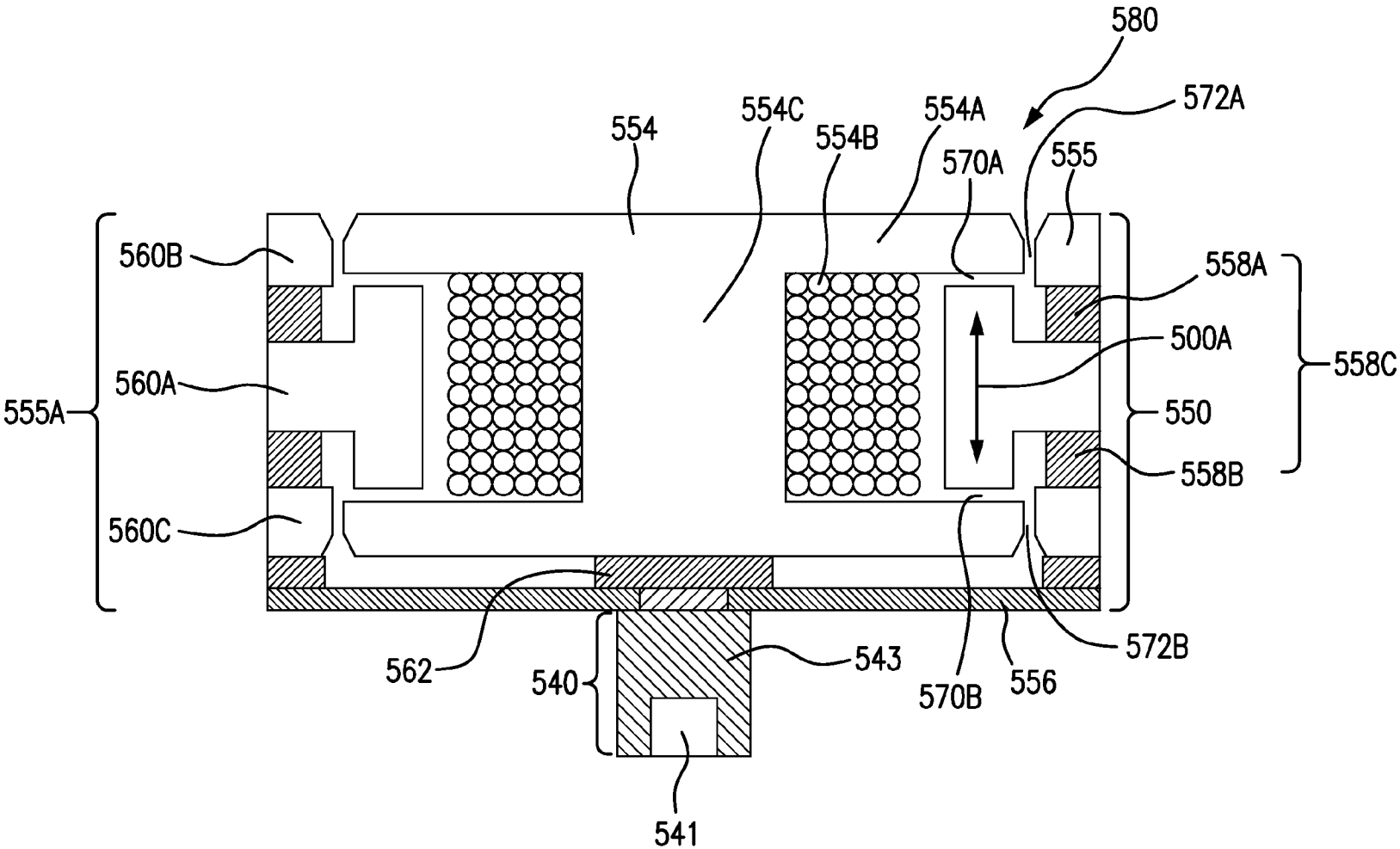
FIG. 5 is a cross-sectional view of an example of a vibrating actuator-coupling assembly of the bone conduction device of FIG. 2.

FIG. 5 is a cross-sectional view of a vibrating actuator-coupling assembly 580, which can correspond to vibrating actuator-coupling assembly 280 detailed above. The vibrating actuator-coupling assembly 580 includes a vibrating electromagnetic actuator 550 and a coupling assembly 540. Coupling assembly 540 includes a coupling 541 mounted on coupling shaft 543. Additional details pertaining to the coupling assembly are described further below with respect to the embodiment of FIG. 6A.

As illustrated in FIG. 5, vibrating electromagnetic actuator 550 includes a bobbin assembly 554 and a counterweight assembly 555. As illustrated, bobbin assembly 554 includes a bobbin 554A and a coil 554B that is wrapped around a core 554C of bobbin 554A. In the illustrated embodiment, bobbin assembly 554 is radially symmetrical.

Counterweight assembly 555 includes spring 556, permanent magnets 558A and 558B, yokes 560A, 560B and 560C, and spacer 562. Spacer 562 provides a connective support between spring 556 and the other elements of counterweight assembly 555 just detailed. Spring 556 connects bobbin assembly 554 via spacer 524 to the rest of counterweight assembly 555, and permits counterweight assembly 555 to move relative to bobbin assembly 554 upon interaction of a dynamic magnetic flux, produced by bobbin assembly 554.

Coil 554B, in particular, may be energized with an alternating current to create the dynamic magnetic flux about coil 554B. Conversely, permanent magnets 558A and 558B generate a static magnetic flux. These permanent magnets 558A and 558B are part of counterweight assembly 555, which also includes yokes 560A, 560B and 560C. The yokes 560A, 560B and 560C can be made of a soft iron in some embodiments.

As may be seen, vibrating electromagnetic actuator 550 includes two axial air gaps 570A and 570B that are located between bobbin assembly 554 and counterweight assembly 555. With respect to a radially symmetrical bobbin assembly 554 and counterweight assembly 555, such as that detailed in FIG. 5, air gaps 570A and 570B extend in the direction of relative movement between bobbin assembly 554 and counterweight assembly 555, indicated by arrow 500A.

Further as may be seen in FIG. 5, the vibrating electromagnetic actuator 550 includes two radial air gaps 572A and 572B that are located between bobbin assembly 554 and counterweight assembly 555. With respect to a radially symmetrical bobbin assembly 554 and counterweight assembly 555, the air gap extends about the direction of relative movement between bobbin assembly 554 and counterweight assembly 555. As may be seen in FIG. 5, the permanent magnets 558A and 558B are arranged such that their respective south poles face each other and their respective north poles face away from each other. It is noted that in an alternate embodiment, the reverse can be the case (respective north poles face towards each other and respective south poles face away from each other).

In the electromagnetic actuator of FIG. 5, the radial air gaps 572A and 572B close static magnetic flux between the bobbin 554A and the yokes 560B and 560C, respectively. Further, axial air gaps 570A and 570B close the static and dynamic magnetic flux between the bobbin 554A and the yoke 560A. Accordingly, in the radially symmetrical device of FIG. 5, there are a total of four (4) air gaps.

It is noted that the electromagnetic actuator of FIG. 5 is a balanced actuator. In alternate configuration a balanced actuator can be achieved by adding additional axial air gaps above and below the outside of bobbin 554B (and in some variations thereof, the radial air gaps are not present due to the addition of the additional axial air gaps). In such an alternate configuration, the yokes 560B and 560C are reconfigured to extend up and over the outside of bobbin 554B (the geometry of the permanent magnets 558A and 558B and/or the yoke 560A might also be reconfigured to achieve utility of the actuator).

Some embodiments of a balanced electromagnetic transducer will now be described that utilize fewer air gaps than the configuration of FIG. 5 and the alternate variations as described above. In some exemplary embodiments, the electromagnetic actuator (balanced and/or unbalanced, as detailed below) is achieved by providing functionality to a resilient element, such as by way of example and not by way of limitation, a spring, beyond that which is normally associated therewith. Embodiments detailed herein are detailed with respect to a spring. It is noted, however, that in alternate embodiments of these embodiments and/or variations thereof, the disclosure of spring also corresponds to the disclosure of a resilient element. More particularly, not only does the spring provide resilient elasticity concomitant with the traditional use of the spring, but the spring also provides a conduit for magnetic flux (static and/or dynamic). In an exemplary embodiment utilizing a spring having such functionality, one or more of the above mentioned air gaps with respect to the embodiment of FIG. 5 (e.g. the radial air gaps) are eliminated and/or one or more of the soft iron parts utilized in that embodiment are not utilized in this exemplary embodiment.

More particularly, it is noted that the balance electromagnetic actuator of FIG. 5 relies on at least four air gaps (while the embodiment of FIG. 5 is depicted as including two axial air gaps and two radial air gaps, other balance electromagnetic actuators utilize four axial air gaps). An exemplary embodiment includes a spring having dual functionality as a traditional spring, on the one hand, and a conduit for magnetic flux, on the other hand, such that at least one or two of the air gaps of the embodiment of FIG. 5 can eliminated. Functionality according to a "traditional spring" includes, for example, an device that elastically deforms/moves from its unloaded position when pushed or pulled or pressed (i.e., subjected to load) and then returns to its original shape/returns to is unloaded position when the pushing, pulling or pressing is removed (load is removed).

In this regard, in some embodiments, there is an electromagnetic actuator that is balanced that has only two air gaps (both axial air gaps) owing to the fact that the spring(s) replaces two of the radial air gaps. That is, the magnetic flux is conducted through spring(s) instead of through air gaps. An exemplary embodiment of such will now be described, followed by some exemplary descriptions of some alternate embodiments.

Figure 6A:
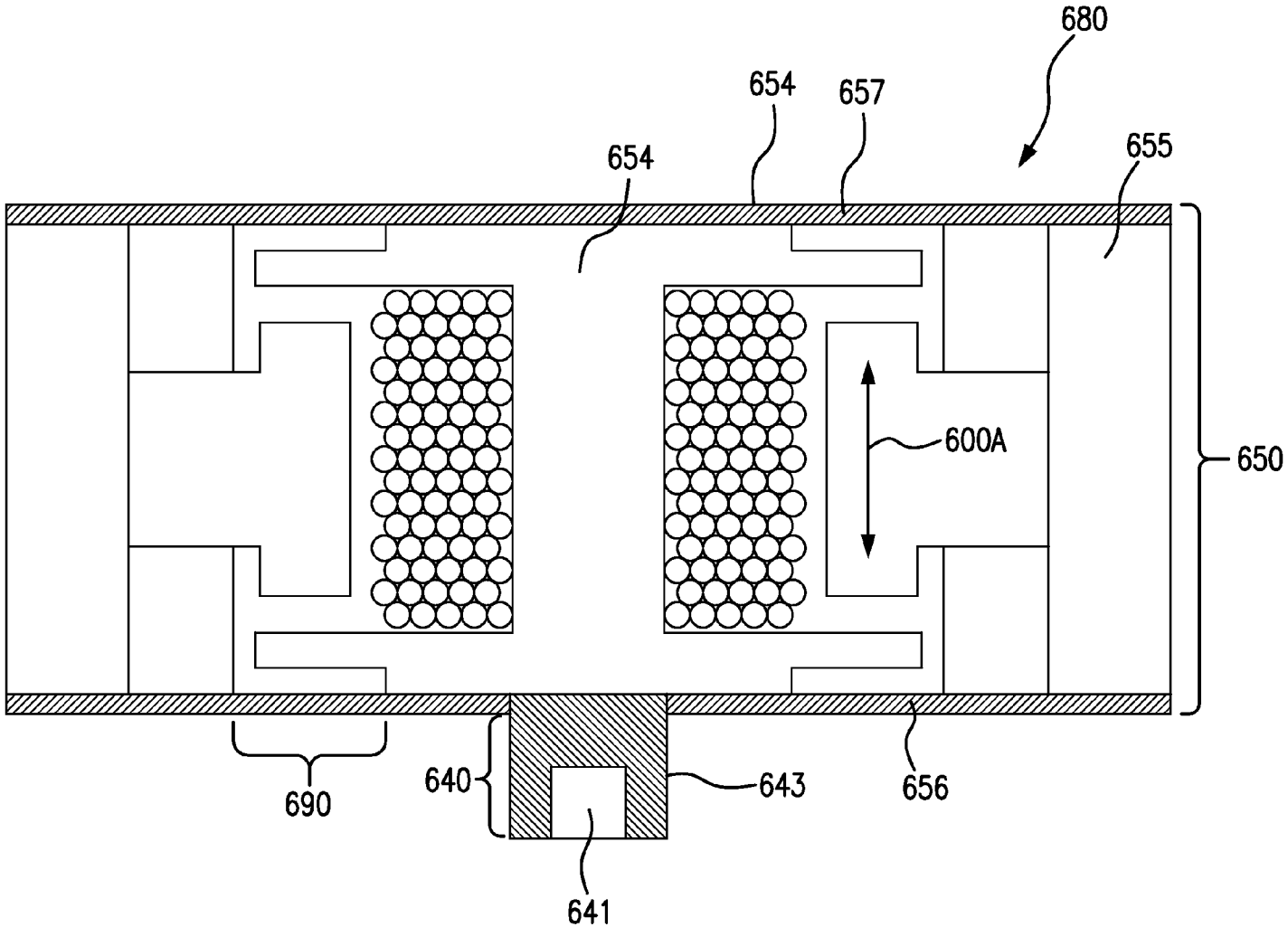
FIG. 6A is a cross-sectional view of an embodiment of a vibrating actuator-coupling assembly of the bone conduction device of FIG. 2.

FIG. 6A is a cross-sectional view of a vibrating actuator-coupling assembly 680, which can correspond to vibrating actuator-coupling assembly 280 detailed above.

Coupling assembly 640 includes a coupling 641 in the form of a snap coupling configured to "snap couple" to an anchor system on the recipient. As noted above with reference to FIG. 1, the anchor system may include an abutment that is attached to a fixture screw implanted into the recipient's skull and extending percutaneously through the skin so that snap coupling 341 can snap couple to a coupling of the abutment of the anchor system. In the embodiment depicted in FIG. 6A, coupling 641 is located at a distal end—relative to housing 242 if vibrating actuator-coupling assembly 680 were installed in bone conduction device 200 of FIG. 2 (i.e., element 680 being substituted for element 280 of FIG. 2)—of a coupling shaft 643 of coupling assembly 640. In an embodiment, coupling 641 corresponds to coupling described in U.S. patent application Ser. No. 12/177,091 assigned to Cochlear Limited. In yet other embodiments, alternate couplings can be used.

Coupling assembly 640 is mechanically coupled to vibrating electromagnetic actuator 650 configured to convert electrical signals into vibrations. In an exemplary embodiment, vibrating electromagnetic actuator 650 (and/or any vibrating electromagnetic actuator detailed herein and/or variations thereof) corresponds to vibrating electromagnetic actuator 250 or vibrating electromechanical actuator 342 or vibrating electromechanical actuator 452 detailed above, and, accordingly, in some embodiments, the teachings detailed above and/or variations thereof with respect to such actuators are included in the genus of devices, genus of systems and/or genus of methods of utilizing the vibrating electromagnetic actuator 650 and/or any vibrating electromagnetic actuator detailed herein and/or variations thereof. This is further detailed below.

In operation, sound input element 126A (FIG. 1A) converts sound into electrical signals. As noted above, the bone conduction device provides these electrical signals to a sound processor which processes the signals and provides the processed signals to the vibrating electromagnetic actuator 650 (and/or any other electromagnetic actuator detailed herein and/or variations thereof—it is noted that unless otherwise specified, any teaching herein concerning a given embodiment is applicable to any variation thereof and/or any other embodiment and/or variations thereof), which then converts the electrical signals (processed or unprocessed) into vibrations. Because vibrating electromagnetic actuator 650 is mechanically coupled to coupling assembly 640, the vibrations are transferred from vibrating electromagnetic actuator 650 to coupling assembly 640 and then to the recipient via the anchor system (not shown).

As noted, the teachings detailed herein and/or variations thereof with respect to any given electromagnetic transducer are not only applicable to a percutaneous bone conduction device such as that according to the embodiment of FIG. 2, but also to a transcutaneous bone conduction device such as those according to embodiments of FIG. 3 and FIG. 4. In this regard, the electromagnetic transducers detailed herein and/or variations thereof can be substituted for the vibrating actuator 342 of the embodiment of FIG. 3 and the vibrating actuator 452 of the embodiment of FIG. 4. Accordingly, some embodiments include an active transcutaneous bone conduction device having the electromagnetic transducers detailed herein and/or variations thereof. Also, some embodiments include a passive transcutaneous bone conduction device having the electromagnetic transducers detailed herein and/or variations thereof. It is further again noted that other medical devices and/or other devices can utilize the electromagnetic transducers detailed herein and/or variations thereof.

Figure 6B:
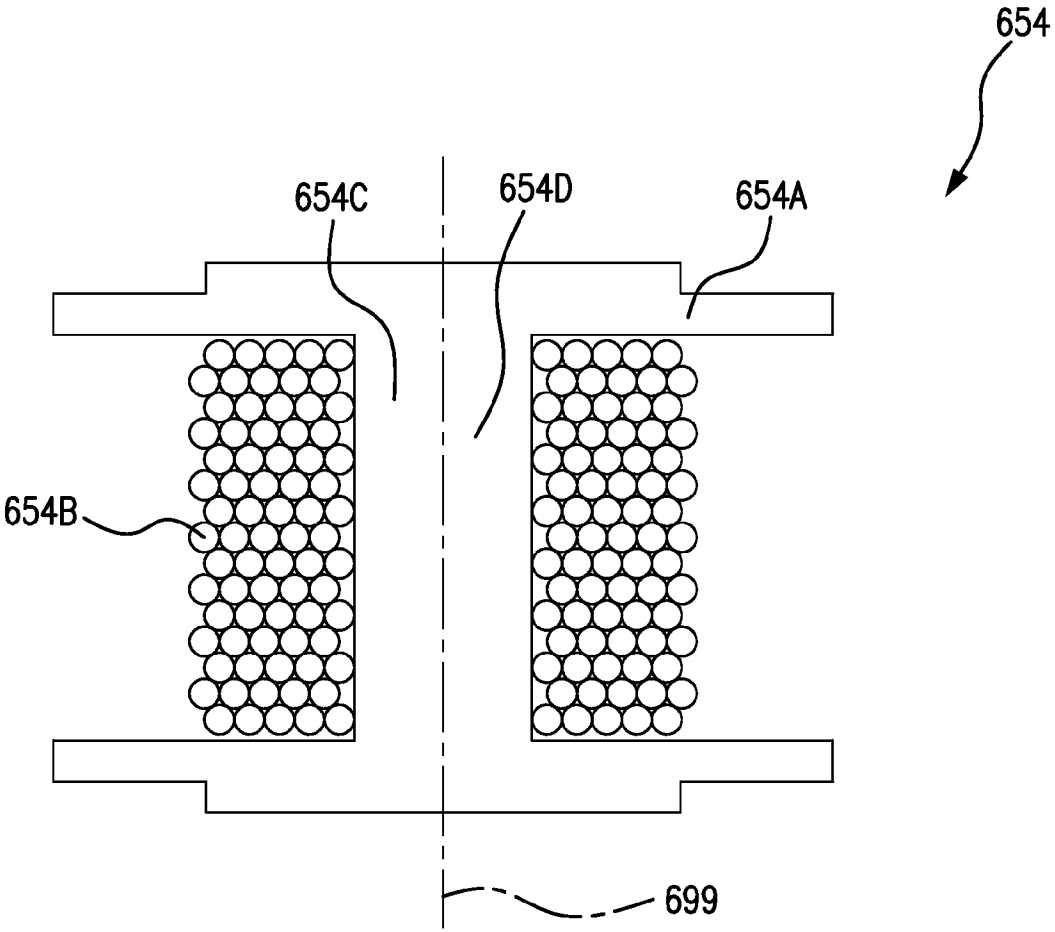
FIG. 6B is a cross-sectional view of the bobbin assembly of the vibrating actuator-coupling assembly of FIG. 3A.

As illustrated in FIG. 6A, vibrating electromagnetic actuator 650 includes a bobbin assembly 654, a counterweight assembly 655 and coupling assembly 640. For ease of visualization, FIG. 6B depicts bobbin assembly 654 separately. As illustrated, bobbin assembly 654 includes a bobbin 654A and a coil 654B that is wrapped around a core 654C of bobbin 654A. In the illustrated embodiment, bobbin assembly 654 is radially symmetrical (i.e., symmetrical about the longitudinal axis 699.

Figure 6C:
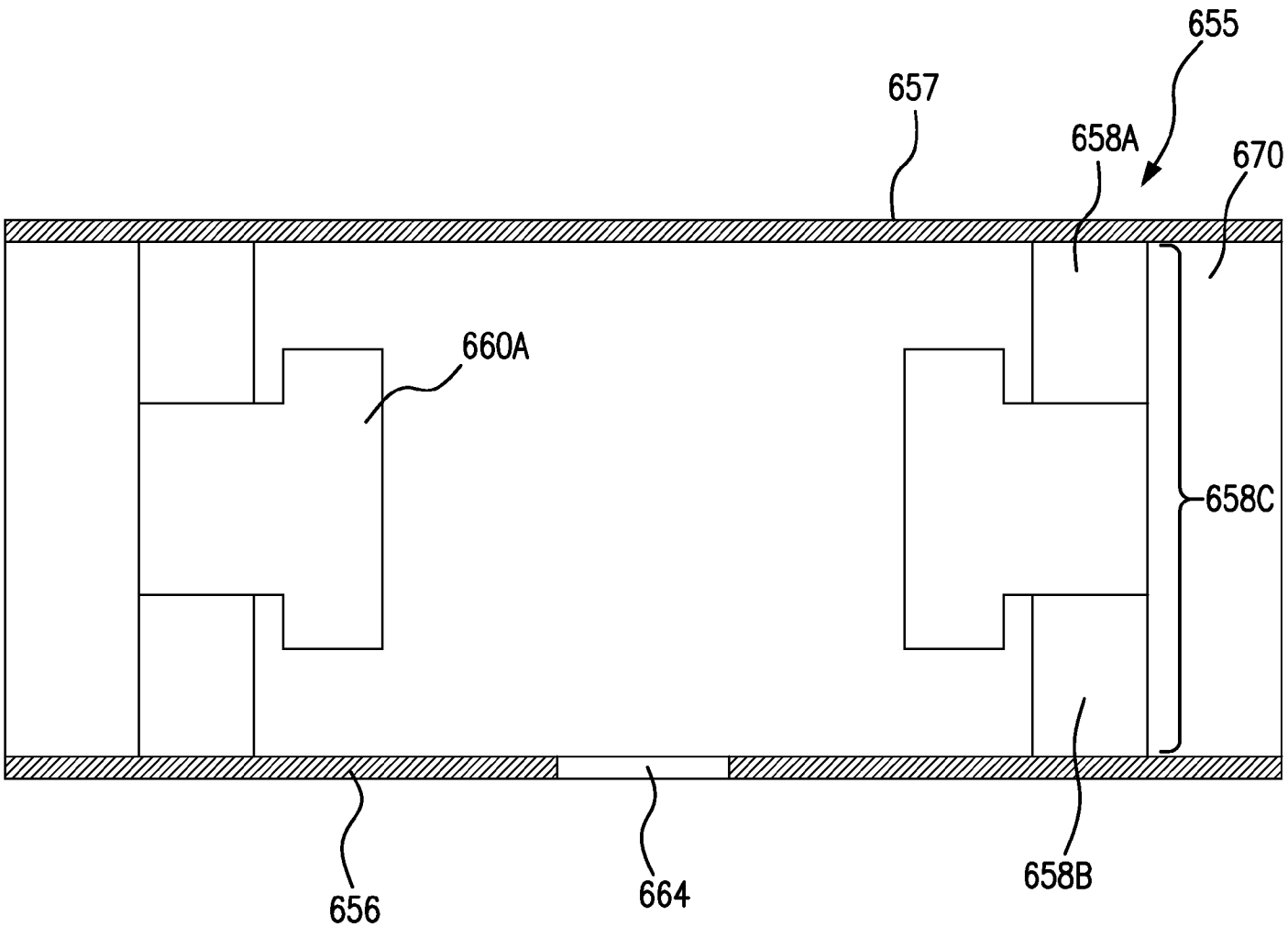
FIG. 6C is a cross-sectional view of the counterweight assembly of the vibrating actuator-coupling assembly of FIG. 3A.

FIG. 6C illustrates counterweight assembly 655 separately, for ease of visualization. As illustrated, counterweight assembly 655 includes springs 656 and 657, permanent magnets 658A and 658B, yoke 660A, and counterweight mass 670. Springs 656 and 657 connect bobbin assembly 654 to the rest of counterweight assembly 655, and permit counterweight assembly 655 to move relative to bobbin assembly 654 upon interaction of a dynamic magnetic flux, produced by bobbin assembly 654. In this regard, with reference back to FIG. 6A, spring 656 includes a flexible section 690 that is not directly connected to any component of the bobbin assembly 654 or to any component of the counterweight assembly 655 that flexes, as will be further detailed below. Along these lines, spring 656 can be directly adhesively bonded, riveted, bolted, welded, etc., directly to the bobbin assembly 654 and/or to any component of the counterweight assembly 655 so as to hold the components together/in contact with one another such that embodiments detailed herein and/or variations thereof can be practiced. Any device, system or method that can be utilized to connect the components of the vibrating actuator-coupling assembly can be utilized in at least some of the embodiments detailed herein and/or variations thereof.

As can be seen, the two permanent magnets 658A and 658B respectively directly contact the springs 656 and 657. That is, there is no yoke or other component (e.g., in the form of a ring) interposed between the magnets and the springs. Accordingly, the magnetic flux generated by the magnets flows directly into the springs without passing through an intermediary component or without passing through a gap. However, it is noted that in an alternate embodiment, there can be an intermediary component, such as a yoke or the like. Further, in some embodiments, there can be a gap between the magnets and the springs.

The dynamic magnetic flux is produced by energizing coil 654B with an alternating current. The static magnetic flux is produced by permanent magnets 658A and 658B of counterweight assembly 655, as will be described in greater detail below. In this regard, counterweight assembly 655 is a static magnetic field generator and bobbin assembly 654 is a dynamic magnetic field generator. As may be seen in FIGS. 6A and 6C, hole 664 in spring 656 provides a feature that permits coupling assembly 641 to be rigidly connected to bobbin assembly 654.

It is noted that while embodiments presented herein are described with respect to a bone conduction device where counterweight assembly 655 includes permanent magnets 658A and 658B that surround coil 654*b* and moves relative to coupling assembly 640 during vibration of vibrating electromagnetic actuator 650, in other embodiments, the coil may be located on the counterweight assembly 655 as well, thus adding weight to the counterweight assembly 655 (the additional weight being the weight of the coil).

As noted, bobbin assembly 654 is configured to generate a dynamic magnetic flux when energized by an electric current. In this exemplary embodiment, bobbin 654A is made of a soft iron. Coil 654B may be energized with an alternating current to create the dynamic magnetic flux about coil 654B. The iron of bobbin 654A is conducive to the establishment of a magnetic conduction path for the dynamic magnetic flux. Conversely, counterweight assembly 655, as a result of permanent magnets 658A and 658B, in combination with yoke 660A and springs 656 (this feature being described in greater detail below), at least the yoke, in some embodiments, being made from soft iron, generate, due to the permanent magnets, a static magnetic flux. The soft iron of the bobbin and yokes may be of a type that increases the magnetic coupling of the respective magnetic fields, thereby providing a magnetic conduction path for the respective magnetic fields.

Figure 7:
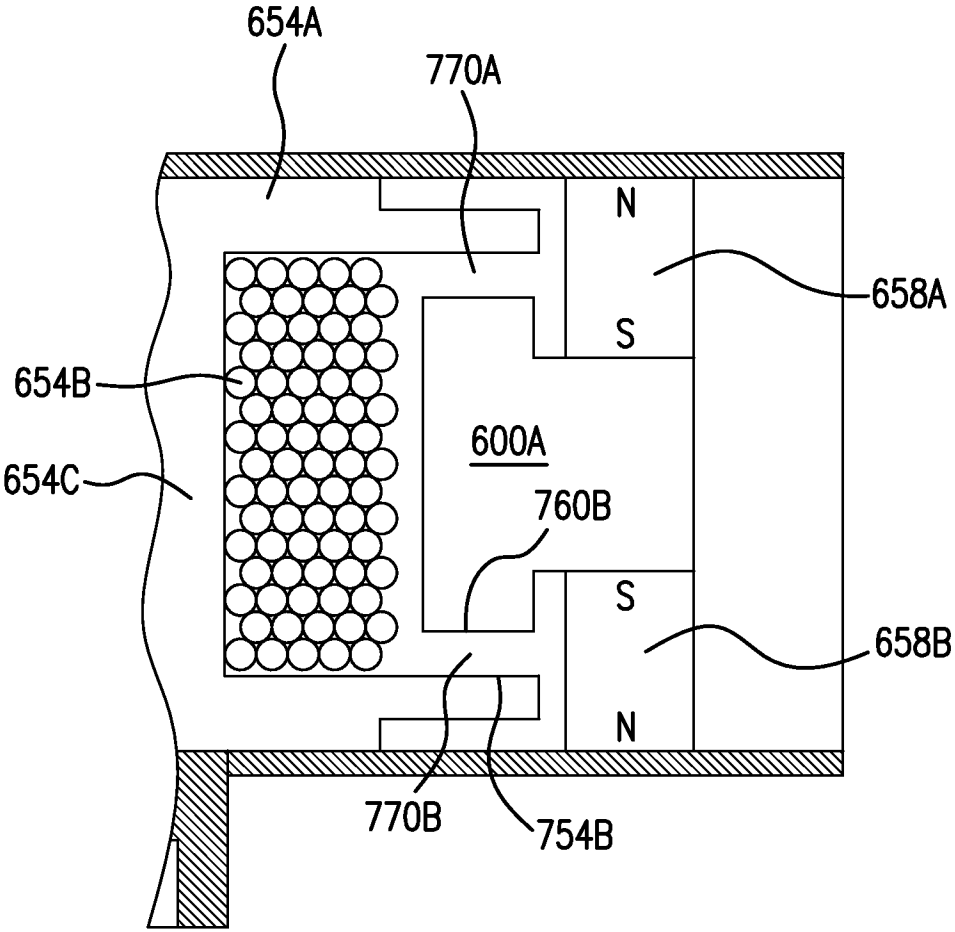
FIG. 7 is a schematic diagram of a portion of the vibrating actuator-coupling assembly of FIG. 6A.

FIG. 7 depicts a portion of FIG. 6A. As may be seen, vibrating electromagnetic actuator 650 includes two axial air gaps 770A and 770B that are located between bobbin assembly 654 and counterweight assembly 655. As used herein, the phrase "axial air gap" refers to an air gap that has at least a component that extends on a plane normal to the direction of primary relative movement (represented by arrow 600A in FIG. 6A—more on this below) between bobbin assembly 654 and counterweight assembly 655 such that the air gap is bounded by the bobbin assembly 654 and counterweight assembly 655 in the direction of relative movement between the two.

Accordingly, the phrase "axial air gap" is not limited to an annular air gap, and encompasses air gaps that are formed by straight walls of the components (which may be present in embodiments utilizing bar magnets and bobbins that have a non-circular (e.g. square) core surface). With respect to a radially symmetrical bobbin assembly 654 and counterweight assembly 655, cross-sections of which are depicted in FIGS. 6A-7, air gaps 770A and 770B extend in the direction of relative movement between bobbin assembly 654 and counterweight assembly 655, air gaps 770A and 770B are bounded as detailed above in the "axial" direction. With respect to FIG. 7, the boundaries of axial air gap 770B are defined by surface 754B of bobbin 654A and surface 760B of yoke 660A.

It is noted that the primary direction of relative motion of the counterweight assembly of the electromagnetic transducer is parallel to the longitudinal direction of the electromagnetic transducer, and with respect to utilization of the transducers in a bone conduction device, normal to the tangent of the surface of the bone 136 (or, more accurately, an extrapolated surface of the bone 136) local to the bone fixtures. It is noted that by "primary direction of relative motion," it is recognized that the counterweight assembly may move inward towards the longitudinal axis of the electromagnetic actuator owing to the flexing of the springs (providing, at least, that the spring does not stretch outward, in which case it may move outward or not move in this dimension at all), but that most of the movement is normal to this direction.

Further as may be seen in FIG. 7, in contrast to the device of FIG. 5, the vibrating electromagnetic actuator 650 includes no radial air gaps located, for example, between bobbin assembly 654 and counterweight assembly 655. As used herein, the phrase "radial air gap" refers to an air gap that has at least a component that extends on a plane normal to the direction of relative movement between bobbin assembly 654 and counterweight assembly 655 such that the air gap is bounded by bobbin assembly 654 and counterweight assembly 655 in a direction normal to the primary direction of relative movement between the two (represented by arrow 600A in FIG. 6A). Accordingly, in some exemplary embodiments, due to the feature of the conductive springs 656 and 657, the radial air gaps of the configuration of FIG. 5 are not utilized in the embodiment of FIG. 6A and variations thereof, and, in some embodiments and variations thereof, there are no additional axial air gaps than those depicted in FIG. 6A.

As can be seen in FIG. 7, the permanent magnets 658A and 658B are arranged such that their respective south poles face each other and their respective north poles face away from each other. It is noted that in other embodiments, the respective south poles may face away from each other and the respective north poles may face each other.

Figure 8A:
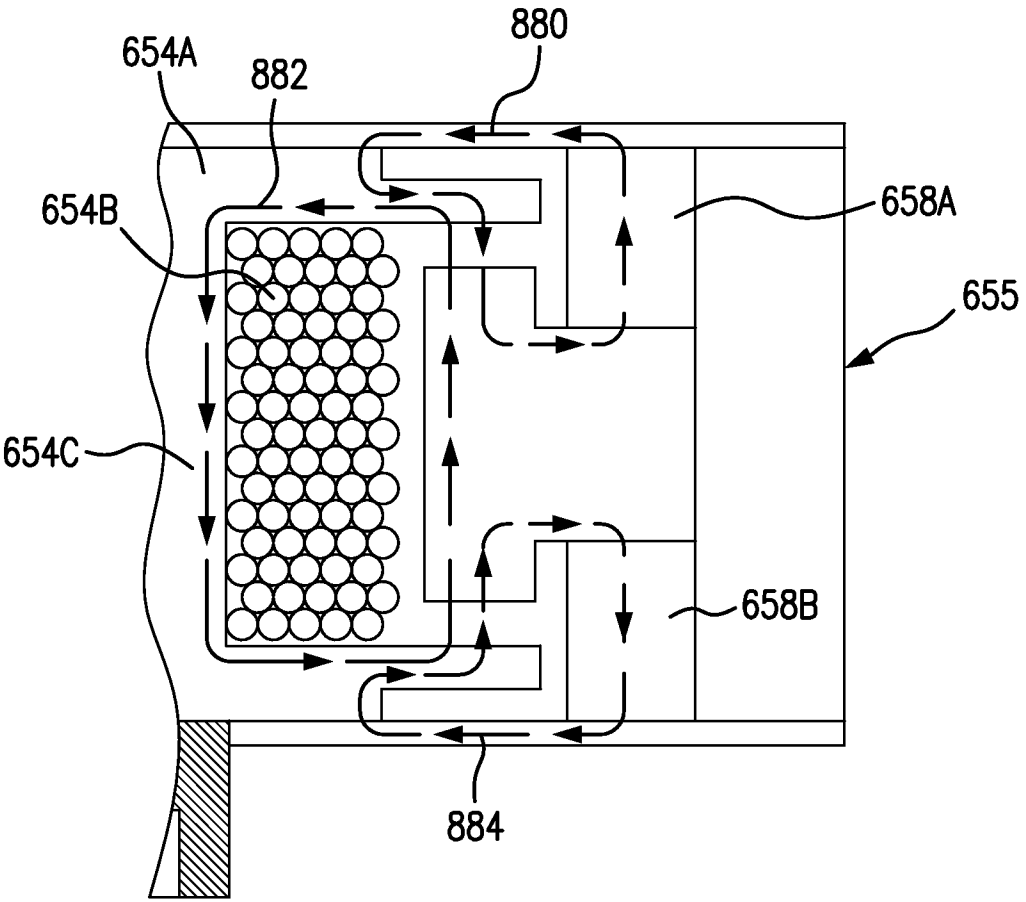
FIGS. 8A and 8B are schematic diagrams detailing static and dynamic magnetic flux in the vibrating actuator-coupling assembly at the moment that the coils are energized when the bobbin assembly and the counterweight assembly are at a balance point with respect to magnetically induced relative movement between the two.

FIG. 8A is a schematic diagram detailing the respective static magnetic flux 880 and static magnetic flux 884 of permanent magnets 658A and 658B, and dynamic magnetic flux 882 of coil 654B in vibrating actuator-coupling assembly 680 when coil 654B is energized according to a first current direction and when bobbin assembly 654 and counterweight assembly 655 are at a balance point with respect to magnetically induced relative movement between the two (hereinafter, the "balance point"). That is, while it is to be understood that the counterweight assembly 655 moves in an oscillatory manner relative to the bobbin assembly 654 when the coil 654B is energized, there is an equilibrium point at the fixed location corresponding to the balance point at which the counterweight assembly 654 returns to relative to the bobbin assembly 654 when the coil 654B is not energized.

Figure 8B:
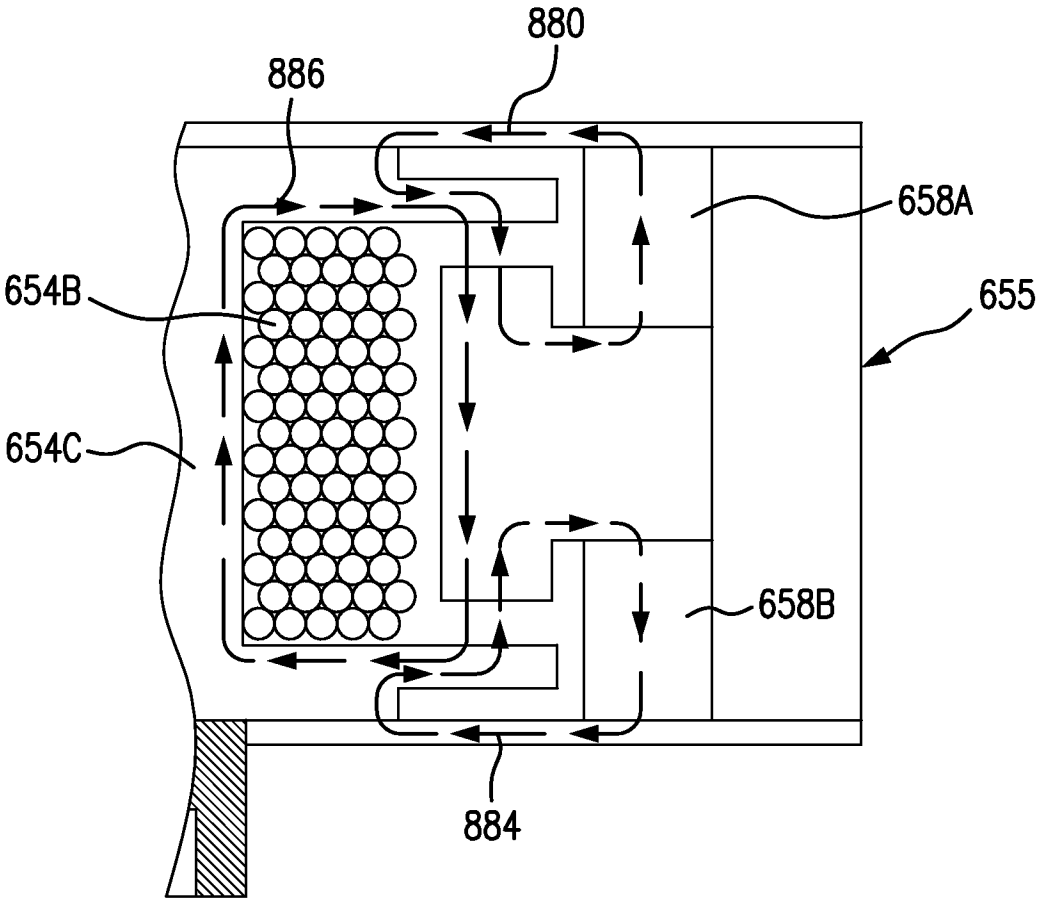

FIG. 8B is a schematic diagram detailing the respective static magnetic flux 880 and static magnetic flux 884 of permanent magnets 658A and 658B, and dynamic magnetic flux 886 of coil 654B in vibrating actuator-coupling assembly 680 when coil 654B is energized according to a second current direction (a direction opposite the first current direction) and when bobbin assembly 654 and counterweight assembly 655 are at a balance point with respect to magnetically induced relative movement between the two.

It is noted that FIGS. 8A and 8B do not depict the magnitude/scale of the magnetic fluxes. In this regard, it is noted that in some embodiments, at the moment that coil 654B is energized and when bobbin assembly 654 and counterweight assembly 655 are at the balance point, relatively little, if any, static magnetic flux flows through the core 654C of the bobbin 654A/the space 654D (see FIG. 6B) in the coil 654B (the space 654D being formed as a result of the coil 654B being wound about, and at least partially filled by, the core 654C of the bobbin 654A). Accordingly, FIGS. 8A and 8B depict this fact. However, during operation, the amount of static magnetic flux that flows through the core increases as the bobbin assembly 654 travels away from the balance point (both downward and upward away from the balance point) and decreases as the bobbin assembly 654 travels towards the balance point (both downward and upward towards the balance point). Still, the amount that travels through the core is minimal compared to the amount the travels through the respective air gaps. In this regard, static magnetic flux circuits 880 and 884 as depicted in FIG. 8A represent an ideal static magnetic flux path, where it is to be understood that magnetic flux, albeit relatively limited quantities, can also travel outside this ideal path.

As can be seen from FIGS. 8A and 8B, the static magnetic flux and the dynamic magnetic flux all cross the same air gaps, and there are no air gaps crossed by the static magnetic flux that are not cross by the dynamic magnetic flux, at least with respect to the ideal paths of the static magnetic flux and the dynamic magnetic flux.

It is noted that the directions and paths of the static magnetic flux and dynamic magnetic flux are representative of some exemplary embodiments, and in other embodiments, the directions and/or paths of the fluxes can vary from those depicted.

As may be seen from FIGS. 8A and 8B, axial air gaps 770A and 770B close static magnetic flux circuits 880 and 884. It is noted that the phrase "air gap" refers to a gap between the component that produces a static magnetic field and a component that produces a dynamic magnetic field where there is a relatively high reluctance but magnetic flux still flows through the gap. The air gap closes the magnetic field. In an exemplary embodiment, the air gaps are gaps in which little to no material having substantial magnetic aspects is located in the air gap. Accordingly, an air gap is not limited to a gap that is filled by air.

Still with reference to FIGS. 8A and 8B, it is noted that static magnetic flux circuits 880 and 884 each constitute closed flux paths/closed circuits. These paths/circuits are considered herein to be "local circuits" in that they are local to the individual permanent magnets that generate the circuit. As can be seen, each closed static magnetic flux path depicted in FIGS. 8A and 8B travels across no more than one air gap. That said, it is noted that in some embodiments or in potentially all embodiments, there is a static magnetic flux that travels across both air gaps. Such a scenario can exist in the case of trace flux and/or in the case of movement of the counterweight assembly 655 from the balance point, where some of the flux from one magnet travels through one air gap and some flux travels through another air gap. Without being bound by theory, such can exist in the scenario where the static magnetic flux also travels through the core of the bobbin. Still, even in such a scenario, there is a closed static magnetic flux path that travels across only one air gap. The path, however, is considered herein to be a "global" circuit as it extends outside the local circuit owing to, for example, its travels through the core of the bobbin.

FIGS. 8A and 8B clearly depict that the static magnetic flux generated by the counterweight assembly 655 travels across only two air gaps. This is as contrasted to the embodiment of FIG. 5, where the generated static magnetic flux crosses four air gaps. In this regard, an exemplary embodiment includes a balanced electromagnetic transducer where only two air gaps are present.

As can be seen from the figures, the dynamic magnetic flux also crosses both air gaps. In an exemplary embodiment, neither the dynamic magnetic flux nor the static magnetic flux crosses an air gap at the other does not cross.

Figure 9A:
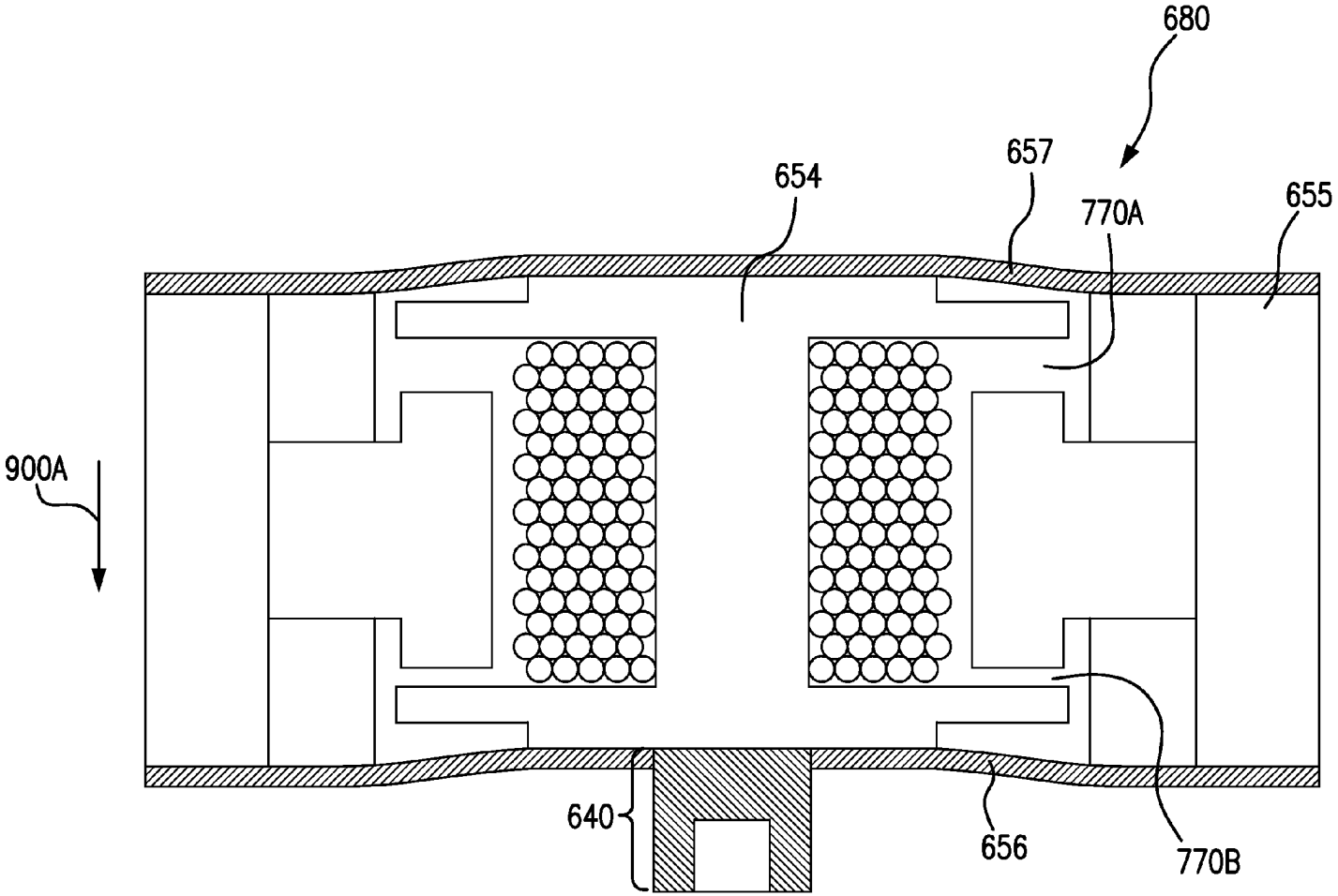
FIG. 9A is a schematic diagram depicting movement of the counterweight assembly relative to the bobbin assembly of the vibrating actuator-coupling assembly of FIG. 6A.

Referring now to FIG. 9A, the depicted magnetic fluxes 880, 882 and 884 of FIG. 8A will magnetically induce movement of counterweight assembly 655 downward (represented by the direction of arrow 900*a* in FIG. 9A) relative to bobbin assembly 654 so that vibrating actuator-coupling assembly 680 will ultimately correspond to the configuration depicted in FIG. 9A. More specifically, vibrating electromagnetic actuator 650 of FIG. 6A is configured such that during operation of vibrating electromagnetic actuator 650 (and thus operation of bone conduction device 200), an effective amount of the dynamic magnetic flux 882 and an effective amount of the static magnetic flux (flux 880, flux 884 and/or a combination of flux 880 and 884) flow through at least one of axial air gaps 770A and 770B sufficient to generate substantial relative movement between counterweight assembly 655 and bobbin assembly 654.

As used herein, the phrase "effective amount of flux" refers to a flux that produces a magnetic force that impacts the performance of vibrating electromagnetic actuator 650, as opposed to trace flux, which may be capable of detection by sensitive equipment but has no substantial impact (e.g., the efficiency is minimally impacted) on the performance of the vibrating electromagnetic actuator. That is, the trace flux will typically not result in vibrations being generated by the electromagnetic actuators detailed herein and/or typically will not result in the generation electrical signals in the absence of vibration inputted into the transducer.

Further, as may be seen in FIGS. 8A and 8B, the static magnetic fluxes enter bobbin 654A substantially only at locations lying on and parallel to a tangent line of the path of the dynamic magnetic fluxes 882.

As may be seen from FIGS. 8A and 8B, the dynamic magnetic flux is directed to flow within the area sandwiched by the springs 656 and 657. In particular, no substantial amount of the dynamic magnetic flux 882 or 886 passes through or into springs 656. Further, no substantial amount of the dynamic magnetic flux 882 or 886 passes through the two permanent magnets 658A and 658B of counterweight assembly 655. Moreover, as may be seen from the FIGs., the static magnetic fluxes (880, 884 and/or a combination of the two) is produced by no more than two permanent magnets 658A and 658B.

It is noted that the schematics of FIGS. 8A and 8B represent respective instantaneous snapshots while the counterweight assembly 655 is moving in opposite directions (FIG. 8A being downward movement, FIG. 8B being upward movement), but both when the bobbin assembly 654 and counterweight assembly 655 are at the balance point.

As counterweight assembly 655 moves downward relative to bobbin assembly 654, as depicted in FIG. 9A, the span of axial air gap 770A increases and the span of axial air gap 770B decreases. This has the effect of substantially reducing the amount of effective static magnetic flux through axial air gap 770A and increasing the amount of effective static magnetic flux through axial air gap 770B. However, in some embodiments, the amount of effective static magnetic flux through springs 656 and 657 collectively substantially remains about the same as compared to the flux when counterweight assembly 655 and bobbin assembly 654 are at the balance point. (Conversely, as detailed below, in other embodiments the amount is different.) Without being limited by theory, this is believed to be the case because the deflection of the springs 656 and 657 is within parameters that do not result in a significant change in spring orientation that substantially impacts the amount of effective static magnetic flux through the springs. That is, the springs do not substantially impact the flow of magnetic flux.

Upon reversal of the direction of the dynamic magnetic flux, the dynamic magnetic flux will flow in the opposite direction about coil 654B. However, the general directions of the static magnetic flux will not change. Accordingly, such reversal will magnetically induce movement of counterweight assembly 655 upward (represented by the direction of arrow 900B in FIG. 9B) relative to bobbin assembly 654 so that vibrating actuator-coupling assembly 680 will ultimately correspond to the configuration depicted in FIG. 9B. As counterweight assembly 655 moves upward relative to bobbin assembly 654, the span of axial air gap 770B increases and the span of axial air gap 770A decreases. This has the effect of reducing the amount of effective static magnetic flux through axial air gap 770B and increasing the amount of effective static magnetic flux through axial air gap 770A. However, the amount of effective static magnetic flux through the springs 656 does not change due to a change in the span of the axial air gaps as a result of the displacement of the counterweight assembly 655 relative to the bobbin assembly 654 for the reasons detailed above with respect to downward movement of counterweight assembly 655 relative to bobbin assembly 654.

Figure 9B:
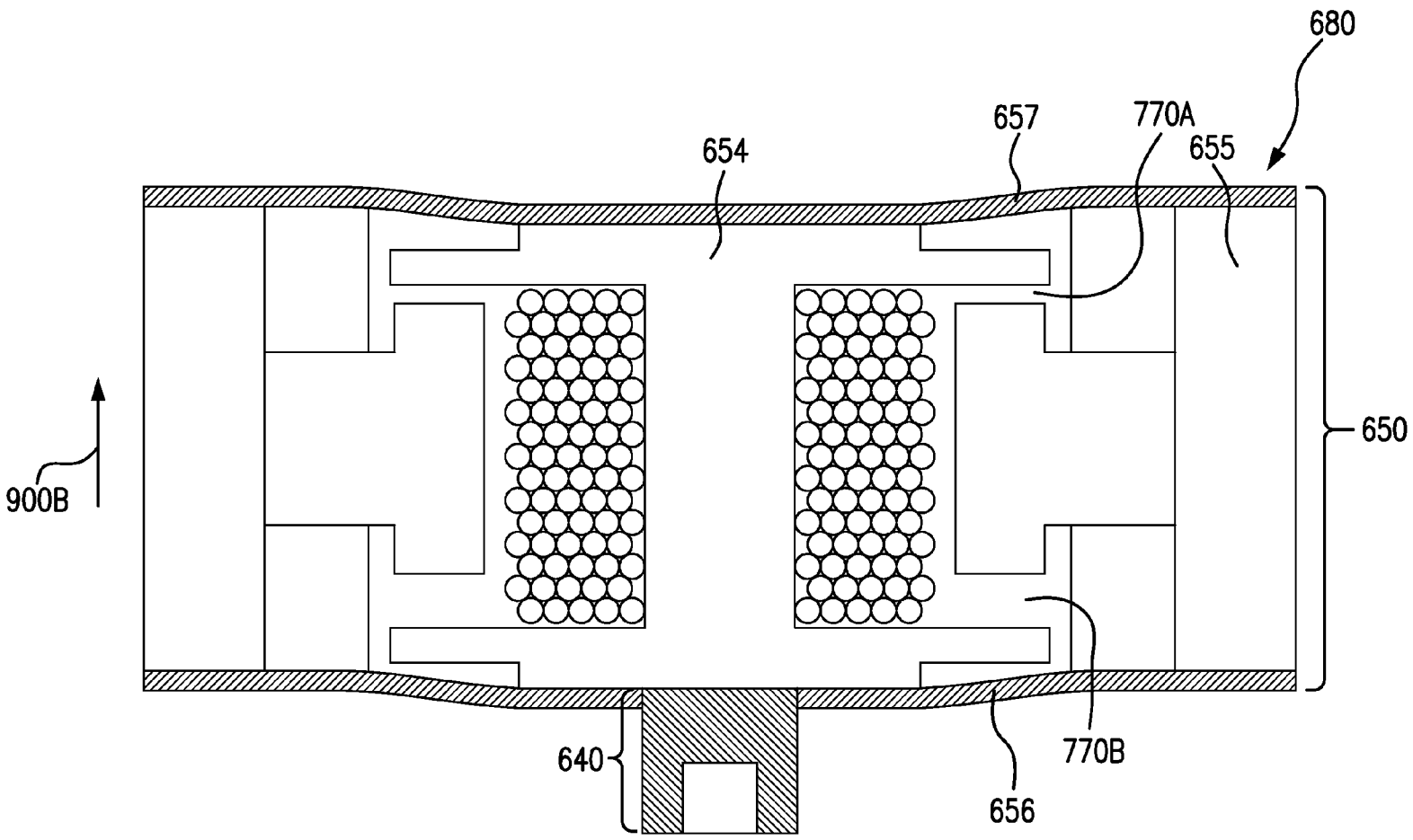
FIG. 9B is a schematic diagram depicting movement of the counterweight assembly relative to the bobbin assembly of the vibrating actuator-coupling assembly of FIG. 6A in the opposite direction of that depicted in FIG. 9A.

As can be seen from FIGS. 9A and 9B, the springs 656 and 657 deform with transduction of the transducer (e.g., actuation of the actuator). Accordingly, at least a portion of the static magnetic flux flows through solid material that deforms during transduction by the electromagnetic transducer. This as contrasted to the flow of static magnetic flux through, for example, the yokes of the embodiment of FIG. 5, where the yokes do not deform during actuation (transduction).

Referring back to FIG. 5, it can be seen that the embodiments thereof utilizes yokes 560B and 560C to establish the radial air gaps between the yokes and the bobbin assembly 354. That is, the embodiment of FIG. 5 utilizes three separate yokes (including yoke 560A). Conversely, the embodiment of FIG. 6A utilizes only one yoke (it is noted that the depictions of FIGS. 6A to 6C are cross-sectional views of a rotationally symmetric vibrating electromagnetic actuator, and thus yoke 660A is in the form of a ring). Note further that in the case of a balanced actuator that utilizes only axial air gaps, it has been heretofore known to utilize yokes that extend above and below (with respect to the orientation of FIG. 5) the bobbin assembly. Accordingly, an exemplary embodiment provides for a balance electromagnetic actuator having fewer yokes.

Note further that the reduction of such components can have utility in that manufacturing tolerance buildup is not as significant of a factor as it might otherwise have been. That is, in the embodiment of FIG. 6A, tolerance buildup affecting the axial air gaps could be limited to the tolerances of the permanent magnet 658B (or permanent magnet 658A) and the yoke 600A. This can have utility in that the size of the axial air gaps can be reduced relative to that which would be utilized to account for tolerance buildup with respect to the embodiment of FIG. 5. This is because there would be less tolerance uncertainty in the embodiment of FIG. 6A.

In some embodiments of the embodiment of FIG. 6A, it is relatively easier to align the various components of the actuator as compared to the implementation of embodiments according to FIG. 5. The potential for tilting of the counterweight assembly components relative to the bobbin assembly components and/or vice-versa is lower relative to that associated with embodiments according to FIG. 5. Such tilting can cause the air gaps, especially the radial air gaps, to collapse or otherwise be reduced in width, such that a deleterious effect on the performance of the actuator results. Along these lines, embodiments according to FIG. 6A need not account for as much tilt relative to one another as embodiments corresponding to FIG. 5 to avoid contact (such as contact while the actuators are vibrating). Still further, because of the reduced span of the flexible portion of the springs relative to embodiments corresponding to FIG. 5, the assemblies are less likely to tilt relative to one another/the assemblies are more resistant to tilting (i.e., for a given force that causes tilting, the embodiment of FIG. 6A tilts less than the embodiment of FIG. 5). Accordingly, the axial air gaps can be less wide in embodiments corresponding to FIG. 6A than in the embodiments corresponding to FIG. 5, all other things being equal. This can have utility in that the relative efficiency of the actuator can be greater than it otherwise might have been.

Accordingly, in an exemplary embodiment, there is an electromagnetic transducer that is configured such that an angle of tilt between the bobbin assembly and the counterweight assembly is about 50%, 55%, 60%, 65%, 70%, 75%, 80%, 85%, 90% or 95% and/or any value or range of values therebetween in about 1% increments (e.g., about 56%, about 88% to about 94%, etc.) for a given tilt force, of that which would be present in an electromagnetic transducer according to the embodiment of FIG. 5 and variations thereof, all other things being equal.

Still further, it is noted that the substitution of the springs for the air gaps also reduces or otherwise eliminates any need to control or otherwise adjusts the size of those air gaps during manufacturing, if only because those air gaps are no longer present. In this regard, with respect to FIG. 5, it is clear that a high degree of concentricity must exist with respect to the bobbin assembly and the counterweight assembly with respect to the radial air gaps. Tolerance buildups alone create difficulty in manufacturing the actuator. Further, there is a high degree of precision required to fit the bobbin assembly into the counterweight assembly. With respect to actuators that utilize four axial air gaps, the tolerance buildups create difficulty in manufacturing the actuator. Because of the reduction in the number of air gaps according to the embodiment of FIG. 6 as compared to that of FIG. 5 and the variations thereof, the number of "controlled dimensions" that impact performance of the actuator are reduced, at least as compared to an actuator having four air gaps, all other things being equal.

Additionally, it is noted that in some embodiments utilizing a spring to close the static magnetic flux, larger axial air gaps can be utilized than those of the embodiment of FIG. 5, all other things being equal. In an exemplary embodiment, this can enable a larger tilt angle between the counterweight assembly and the bobbin assembly without having one component contact the other component as compared to that according to the embodiment of FIG. 5, all other things being equal. More specifically, in an exemplary embodiment, there is an electromagnetic transducer that is configured such that an angle of tilt between the bobbin assembly and the counterweight assembly resulting in contact between the two components, as referenced from the same relative positions (e.g., at the balance point, the top of the transduction motion, the bottom of the transduction motion, etc.) is about 105%, 110%, 115%, 120%, 125%, 130%, 135%, 140%, 145% or 150% and/or any value or range of values therebetween in about 1% increments (e.g., about 116%, about 121% to about 138%, etc.) of that which would be present in an electromagnetic transducer according to the embodiment of FIG. 5 and variations thereof, all other things being equal.

The embodiments of FIGS. 6A-9B detailed above include the use of two separate springs 656 and 657 as conduits of the static magnetic flux and no radial air gaps. In an alternate embodiment, only one spring is used (either the top or the bottom spring) as a conduit of static magnetic flux (but two or more springs may be present—the additional springs being utilized for their traditional resilient purposes), and in the place of the other spring, a radial air gap located between bobbin assembly 654 and counterweight assembly 655 is utilized to close the static magnetic flux. It is noted that in an alternate embodiment, two or more springs can be utilized as conduits for static magnetic flux along with one or two or more radial air gaps.

Figure 10:
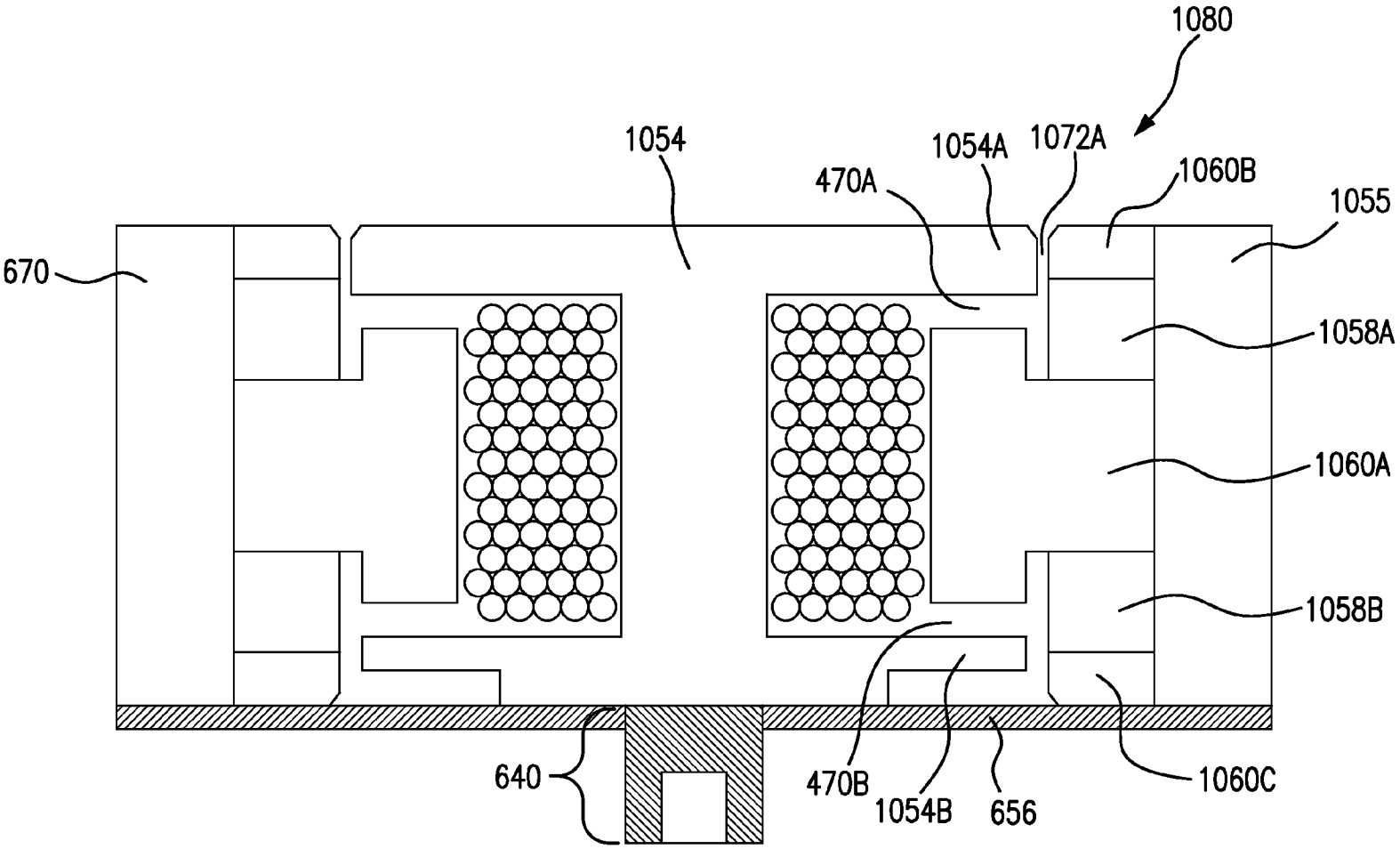
FIG. 10 is a cross-sectional view of an alternate embodiment of a vibrating actuator-coupling assembly of the bone conduction device of FIG. 2.

More particularly, FIG. 10 depicts an alternate embodiment of a vibrating actuator-coupling assembly 1080, that utilizes both a spring 656 and a radial air gap 1072A to close the static magnetic flux, where like reference numbers correspond to the components detailed above. As can be seen, bobbin assembly 1054 includes a bobbin that has arms 1054A and 1054B that are different from one another, with arm 1054B corresponding to the bottom arm of the bobbin 654A of FIG. 6A. However, arm 1054A extends further in the lateral direction than arm 1054B, and arm 1054A is "thicker" in the longitudinal direction than arm 1054B, at least with respect to the portions closest to counterweight assembly 1055.

As can be seen, permanent magnets 1058A and 1058B are of a different geometry than the permanent magnets of the embodiment of FIG. 6A. More particularly, in the embodiment depicted in FIG. 10, the permanent magnets 1058A and 1058A are shorter than the permanent magnets of FIG. 6A. Also, the permanent magnets 1058A and 1058B are of the same configuration, although in other embodiments, different configurations can be utilized. In this regard, depending on the path of the magnetic fluxes, different sized permanent magnets (i.e., magnets of different strength) can be utilized to obtain a balanced vibrating actuator.

Referring still to FIG. 10, it can be seen that yokes 1060B and 1060C have been added in addition to yoke 1060A (which corresponds to yoke 660A of FIG. 6A). The magnetic flux generated by permanent magnet 1058B flows through yoke 1060A and bobbin assembly 1054 and spring 656 in a manner substantially the same as that detailed above with respect to the embodiment of FIGS. 6A-9B, with the exception that the flux also flows through yoke 1060C. With regard to the flow of flux through yoke 1060C, the flux flows in a substantially linear manner therethrough (i.e., vertically into and out of yoke 1060C). Conversely, the magnetic flux generated by permanent magnet 1058A flows through yoke 1060B and bobbin assembly 1054A in a manner more akin to the flux of permanent magnet 558A of FIG. 5. In at least general terms, the flux enters yoke 1060B in a vertical direction, and then arcs to a generally horizontal direction to leave the yoke 1060B and enter arm 1054A of bobbin assembly 1054 across radial air gap 1072A. In this regard, radial air gap 1072A generally corresponds to the radial air gap between yoke 560B and bobbin 554A of FIG. 5. The flux then arcs from the horizontal direction to the vertical direction to flow into yoke 1060A across axial air gap 470A. (It is noted that the just described flux flows would be reversed for magnets having an opposite polarity than that which would result in the just described flow. In some embodiments any direction of magnetic flux flow can be utilized, providing that the teachings detailed herein and/or variations thereof can be practiced.)

It is noted that in the embodiment of FIG. 10, a number of the components are depicted as being symmetrical and/or are identical to one another (albeit some are reversed). However, in other embodiments the configurations of the components can be varied. By way of example only and not by way of limitation, because of the presence of radial air gap 1072A at the "top" of the actuator and the absence of such an air gap at the "bottom" of the actuator (while there is a gap, the gap is relatively much larger than the radial air gap 1072A at the top (although in other embodiments, this is not the case) and little to no magnetic flux flows through that gap (instead the flux flows through the spring), and thus it is not an air gap), there may be utilitarian value in utilizing a permanent magnet 1058A that is stronger than permanent magnet 1058B and/or utilizing a yoke 1060B that is different from yoke 1060C, etc., at least if such results in a balanced actuator. Indeed, in some embodiments, the bottom yoke 1060C might be eliminated, and an elongated permanent magnet 1058B and/or the geometry of yoke 1060A being substituted in its place. With regard to the latter scenario, while the embodiment of yoke 1060A is depicted as being symmetrical, other embodiments can include a yoke that is not symmetrical, at least in order to compensate for any flux path discrepancies resulting from utilizing the spring 656 on the bottom and the radial air gap 1072A on the top.

It is noted that the distance spanning the radial air gap 1060B can be set during design so as to result in a utilitarian balanced actuator. Alternatively, or in addition to this, the properties of the spring 656 can be set during design to achieve such a balanced actuator. (Exemplary properties of the spring 656 that can be set during design are described below.) In this regard, owing to the fact that there is no corresponding radial air gap at the bottom of the actuator, in an exemplary embodiment, there is a relationship between the distance of the air gap 1072A and the thickness of the spring 656 that exists such that with respect to other parameters, a balance actuator is achieved.

While the embodiment of FIG. 10 includes a radial air gap located at the top but not at the bottom, in an alternative embodiment the radial air gap and the corresponding componentry is located at the bottom instead of the top (and the spring and corresponding componentry is located at the top).

As noted above, the embodiment of FIG. 10 utilizes yokes positioned at both the north and south Poles of the permanent magnets, as opposed to the embodiment of FIG. 6A, which utilizes a yoke only at the north or south poles of the permanent magnets. In an exemplary embodiment, yokes can be positioned on both sides of the permanent magnets (i.e., interposed between the permanent magnets and the respective springs, along with a yoke (or more than one yoke) interposed between the two permanent magnets. Any configuration and/or flux path flow that can be utilized to practice embodiments detailed herein and/or variations thereof can be utilized in some embodiments.

Referring back to FIG. 6A, because of the elimination of corresponding air gaps via use of springs 656 and 657 to close the static magnetic flux, the tendency of such eliminated air gaps to collapse is correspondingly effectively eliminated, and, in an exemplary embodiment, the spring constant need not be as high as might be the case in embodiments that utilize four axial air gaps, such as that detailed above with respect to FIG. 5 and variations thereof.

As can be seen from the embodiments illustrated in the figures, all permanent magnets of counterweight assembly 655 that are configured to generate the static magnetic fluxes 880 and 884 are located to the sides of the bobbin assembly 655. Along these lines, such permanent magnets may be annular permanent magnets with respective interior diameters that are greater than the maximum outer diameter of the bobbin 654A, when measured on the plane normal to the direction (represented by arrow 900A in FIG. 9A) of the generated substantial relative movement of the counterweight assembly 655 relative to the bobbin assembly 654, as illustrated in FIGS. 9A and 9B. Conversely, in an alternate embodiment, some or all of the permanent magnets of counterweight assembly 655 that are configured to generate the static magnetic fluxes are located above and/or below the bobbin assembly 655.

In some embodiments, the configuration of the counterweight assembly 655 reduces or eliminates the inaccuracy of the distance (span) between faces of the components forming the air gaps that exists due to the permissible tolerances of the dimensions of the permanent magnets. In this regard, in some embodiments, the respective spans of the axial air gaps 770A and 770B, when measured when the bobbin assembly 654 and the counterweight assembly 655 are at the balance point, are not dependent on the thicknesses of the permanent magnets 658A and 658B as compared to the embodiment of FIG. 5 and/or variations thereof, all other things being equal.

It is noted that while the surfaces creating the radial air gap of FIG. 10 are depicted as uniformly flat, in other embodiments, the surfaces may be partitioned into a number of smaller mating surfaces. It is further noted that the use of radial air gap 1072A permits relative ease of inspection of the radial air gaps from the outside of the vibrating electromagnetic actuator 650, in comparison to, for example absence of the radial air gap.

Figure 11:
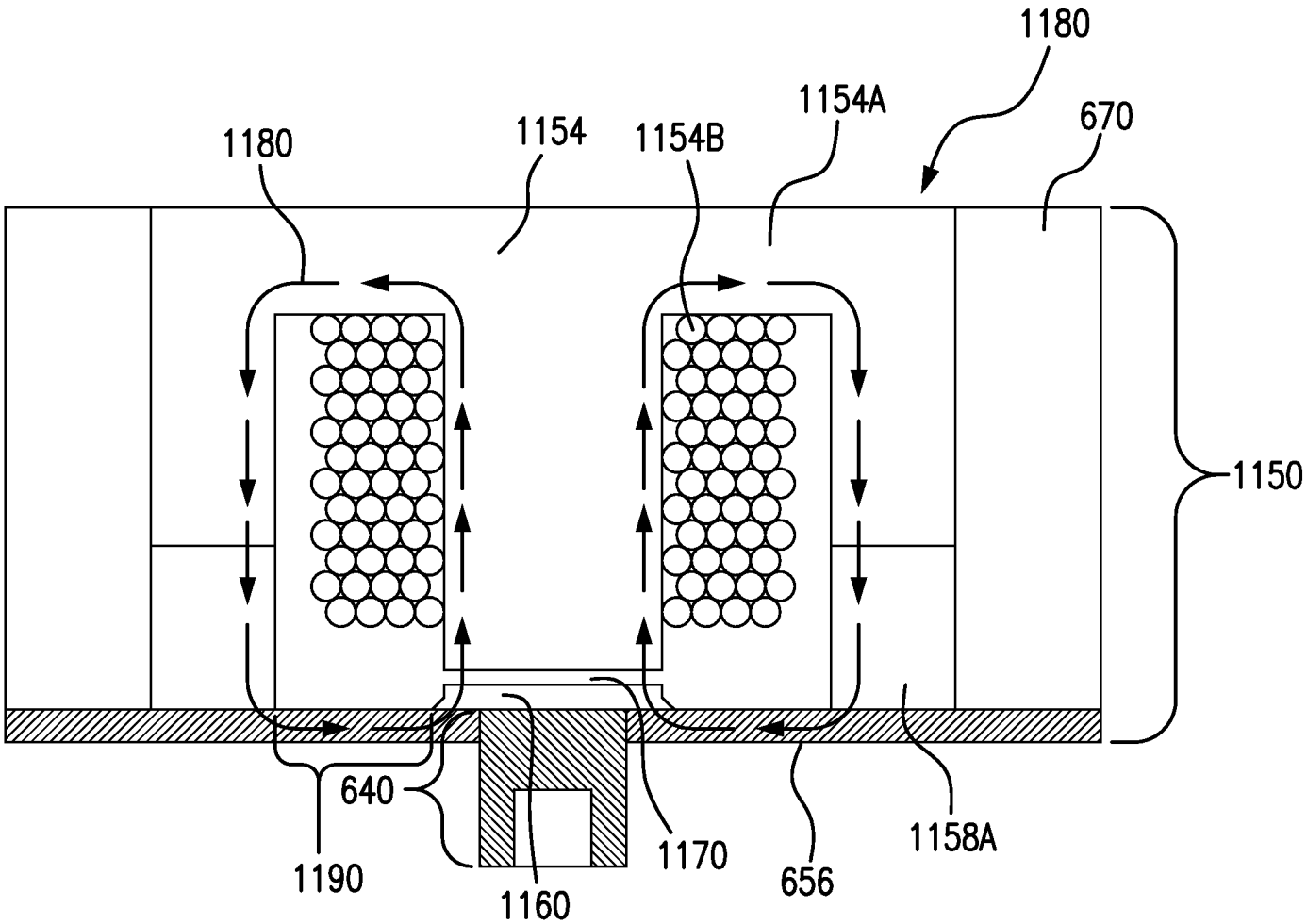
FIG. 11 is a cross-sectional view of an alternate embodiment of a vibrating actuator-coupling assembly of the bone conduction device of FIG. 2.

FIG. 11 depicts an exemplary alternate embodiment of a vibrating actuator, one that is unbalanced, as will now be described.

FIG. 11 is a cross-sectional view of a vibrating actuator-coupling assembly 1180, which can correspond to vibrating actuator-coupling assembly 280 detailed above. Like reference numbers corresponding to elements detailed above will not be addressed.

As illustrated in FIG. 11, vibrating electromagnetic actuator 1150 includes a bobbin assembly 1154 connected to coupling assembly 640 via spring 656. Reference numeral 1190 indicates the flexible section of the spring 656, a section of the spring which flexes because, in this embodiment, it is not directly connected to any component of the bobbin assembly or to any component of the yoke 1160. It is noted that in some embodiments, yoke 1160 can flex to a certain degree, and thus those sections of spring 655 that are connected to the flexing portions of yoke 1160 also flex. Accordingly, section 1190 can extend into the section attached to yoke 1160 in some embodiments. It can be seen that mass 670 is attached to bobbin 1154A of bobbin assembly 1154. In the embedment of FIG. 11, the bobbin assembly 1154 also functionally serves as a counterweight assembly. (It is noted that the embodiments detailed above likewise can be configured in alternate variations such that the bobbin assembly, or at least portions thereof, functionally correspond to the counterweight.)

Spring 656 permits the bobbin assembly 1154 and mass 670 to move relative to yoke 1160 and coupling assembly 640, which is connected thereto, upon interaction of a dynamic magnetic flux, produced by bobbin assembly 1154 upon energizement of coils 1154B. More particularly, a dynamic magnetic flux is produced by energizing coil 1154B with an alternating current. The dynamic magnetic flux is not shown, but it parallels the static magnetic flux 1180 produced by permanent magnet 1158A of the bobbin assembly. That is, in an exemplary embodiment, the dynamic magnetic flux, if depicted, would be located at the same place as the depicted static magnetic flux 1180, with the exception that the arrow heads would change direction depending on the alternation of the current.

In this regard, bobbin assembly 1154 is both a static magnetic field generator and a dynamic magnetic field generator.

The functionality and configuration of the elements of the embodiment of FIG. 11 (and FIG. 12 detailed below) can correspond to that of the corresponding functional elements of one or more or all of the other embodiments detailed herein.

Vibrating electromagnetic actuator 1150 includes a single axial air gap 1170 that is located between bobbin assembly 1154 and yoke 1160. In this regard, the spring 656 is utilized to close both the static and dynamic magnetic flux, and both fluxes are closed through the same air gap 1170 (and thus a single air gap 1170).

It is noted that the directions and paths of the static magnetic fluxes (and thus by description above, the dynamic magnetic fluxes) are representative of some exemplary embodiments, and in other embodiments, the directions and/or paths of the fluxes can vary from those depicted.

As noted above, coupling assembly 640 is attached (either directly or indirectly) to yoke 1160. Without being bound by theory, yoke 1160, in some embodiments, channels the fluxes into and/or out of (depending on the alternation of the current and/or the polarity direction of the permanent magnet 1158A) the bobbin assembly so as to achieve utilitarian functionality of the vibrating electromagnetic actuator 1150. It is noted that in an alternate embodiment, yoke 1160 is not present (i.e., the fluxes enter and/or exit or at least substantially enter and/or exit the spring 656 from/to the bobbin assembly 1154).

Figure 12:
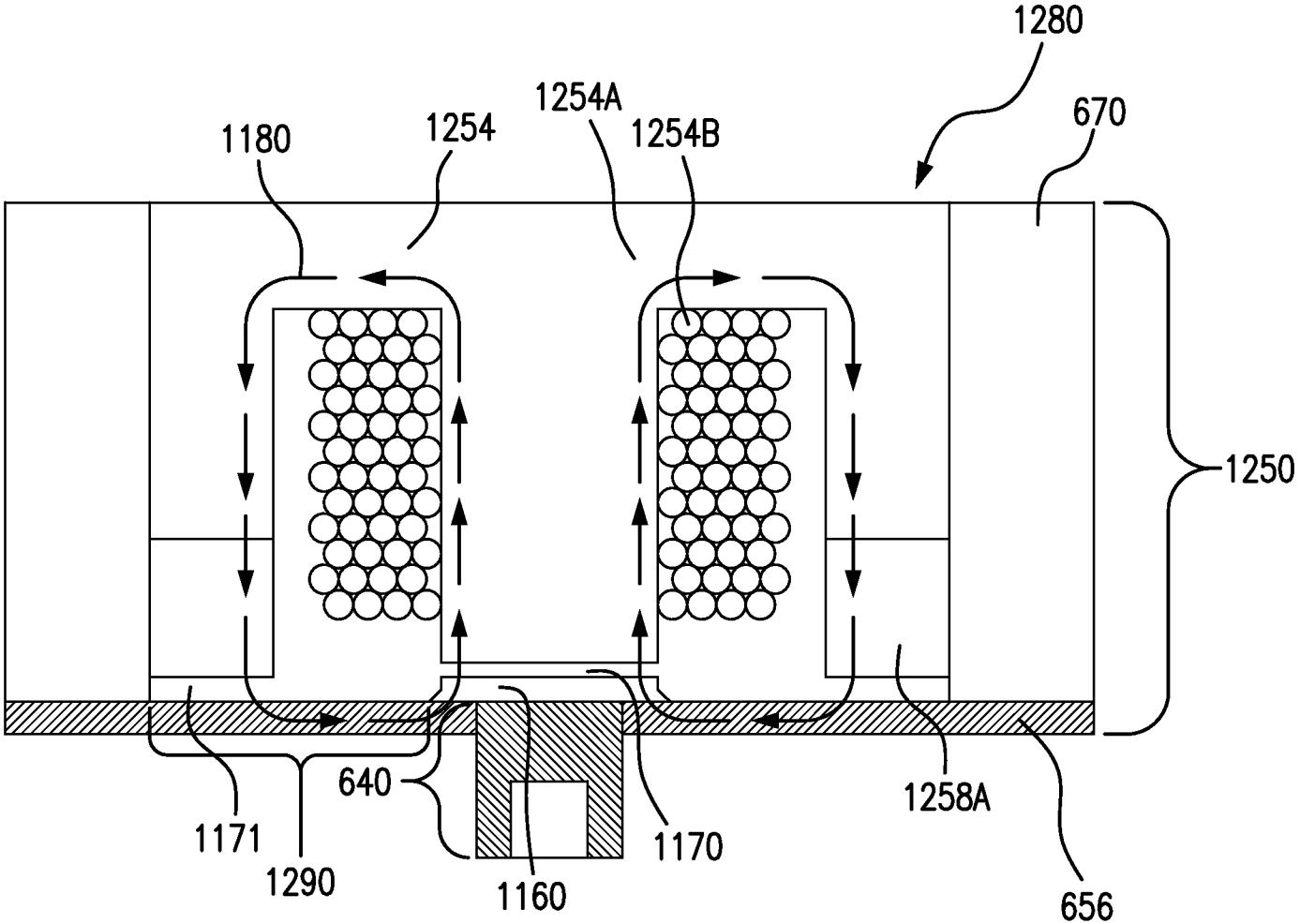
FIG. 12 is a cross-sectional view of an alternate embodiment of a vibrating actuator-coupling assembly of the bone conduction device of FIG. 2.

As can be seen, the flux enters and/or exits magnet 1158A directly from or to spring 656. Conversely in an alternate embodiment this is not the case. In this regard, FIG. 12 depicts an alternate embodiment of a vibrating electromagnetic actuator 1250 of a vibrating actuator-coupling assembly 1280, where the fluxes enter and/or exit a further axial air gap 1171. Reference numeral 1290 indicates the flexible section of the spring 655, corresponding to flexible section 1190 detailed above.

Still with reference to FIG. 12, it can be seen that the gap between the yoke 1160 and the bobbin 1254 is smaller than the gap between spring 656 and permanent magnet 1258A. This is done to account for tilting of the bobbin assembly/counterweight assembly relative to the coupling assembly 640. In this regard, the distance moved as a result of relative tilting between the assemblies of the vibrating actuator-coupling assembly 1280 will typically be greater with increasing distance away from the longitudinal axis. In this regard, the larger gap between the permanent magnet 1258A and spring 656 as compared to the gap between the yoke 1160 and the bobbin 1254 accounts for this phenomenon, thus reducing and/or eliminating the likelihood that these components contact each other during tilting. In some exemplary embodiments, in an un-energized actuator, the gap between the yoke 1160 and the bobbin 1254 is about 60 microns, and the gap between the spring 656 and the permanent magnet 1258A is about 250 microns. That said, in an alternate embodiment, because of the resilient nature of the spring 656, in an exemplary embodiment, the width of the gaps may be equal. Without being bound by theory, in an exemplary embodiment, the resiliency of the spring 656 reduces and/or eliminates potential deleterious effects of contact between the spring and the permanent magnet. Of course, with respect to the embodiment of FIG. 11, where the permanent magnet 1158A is secured to spring 656, there is no gap between these two components at all. Accordingly, in an exemplary embodiment, there is a transducer where there is no meaningful discrepancy between the widths of the air gaps during operation thereof.

In view of the above, embodiments detailed herein and or variations thereof can enable a method of transducing energy. In an exemplary embodiment of this method there is the action of moving the counterweight assembly 655 relative to the bobbin assembly 654A in an oscillatory manner. This action is such that during the movement of the two assemblies relative to one another, there is interaction of a dynamic magnetic flux and a static magnetic flux (e.g. at the air gaps). An exemplary method further includes the action of directing the static magnetic flux along a closed circuit that in its totality extends across one or more air gaps. In an exemplary embodiment, this action is such that all of the one or more air gaps have respective widths that vary while the static magnetic flux is so directed and interacting with the dynamic magnetic flux. This action is further qualified by the fact that if there is more than one air gap present in the closed-circuit (e.g., the embodiment of FIG. 12, as compared to for example the embodiment of FIG. 6A or the embodiment of FIG. 11), a rate of change of variation of the width of one of the air gaps of the closed-circuit is different from that of at least one of the other air gaps of the closed-circuit. Along these lines, it can be seen from FIG. 12 that the air gap between the spring and the permanent magnet will vary in width at a different rate than that of the air gap between the yoke and the bobbin. This is in contrast to, for example, the embodiment of FIG. 5, where the closed static magnetic flux crosses two air gaps, where the width of one of the air gaps (i.e. the radial air gap) does not vary while the static magnetic flux interacts with the dynamic magnetic flux. Further, in an exemplary embodiment, the amount of width variation of the air gap between the spring and the permanent magnet will vary by a different amount than that of the air gap between the yoke and the bobbin.

At least some embodiments detailed herein and/or variations thereof enable a method to be practiced where static magnetic flux is directed along a path that extends through a solid body while the solid body flexes (e.g., the embodiment of FIGS. 6A, 10, 11 and 12).

It is noted that some exemplary embodiments include any device, system and/or method where static and/or magnetic flux travels through a spring in a manner that eliminates an air gap due to the use of the spring in such a manner. Along these lines, it is noted that unless otherwise specified, any of the specific teachings detailed herein and/or variations thereof can be applicable to any of the embodiments detailed herein and/or variations thereof unless otherwise specified.

The elimination of some or all of the radial and/or axial air gaps via the use of, for example, a spring to close the magnetic flux, can make the actuator more efficient as compared to other actuators that instead utilize corresponding radial and/or axial air gaps. In this regard, air gaps can present substantial magnetic reluctances. The relative reduction and/or elimination of such magnetic reluctance to make the actuator more efficient relative to an actuator utilizing such air gaps. In an exemplary embodiment, this can permit smaller permanent magnets to be used/weaker permanent magnets to be used while obtaining the same efficacy as an actuator utilizing such air gaps, all other things being equal. In an exemplary embodiment, the mass of the permanent magnets and/or strength of the permanent magnets, all other things being equal, is about 50%, 55%, 60%, 65%, 70%, 75%, 80%, 85%, 90% or about 95%, and/or is about any value or range of values therebetween in about 1% increments (e.g., 61%, 66% to 94%, etc.) of that for an actuator utilizing such air gaps, all other things being equal.

Different performance parameters can be obtained by varying design parameters of a given actuator, and thus obtaining an actuator having such design parameters. For example, varying the mechanical stiffness of the springs (k) varies the resonance frequency of the actuator. Varying the magnetic flux conductive properties of the springs varying the amount of magnetic flux that can be conducted by the springs. In some exemplary embodiments of balance electromagnetic actuators detailed herein and/or variations thereof, one or more or all of the springs only effectively conduct static magnetic flux. That is, little to no dynamic magnetic flux is conducted by the spring(s) (any dynamic magnetic flux conducted by the springs only amounts to trace amounts of flux). In an exemplary embodiment, the springs are made of a material that have a high saturation flux density, and the magnetic permeability of the material is generally unspecified (e.g. it can be within a range from and including low to high permeability, at least providing that the spring has a sufficiently high saturation flux density to accept the static magnetic flux, which does not vary, in contrast to the dynamic magnetic flux).

Without being bound by theory, it is believed that in at least some exemplary embodiments, embodiments of the electromagnetic transducers utilizing springs as flux conduits detailed herein and/or variations thereof can be designed based on an understanding that while the spring(s) constitute bottlenecks for the static magnetic flux, these are bottlenecks that do not change with performance of the transducer. That is, designing the actuators can be optimized and rendered more efficient than those of, for example, the embodiment of FIG. 5 and variations thereof, provided that this understanding is taken into account. Along these lines, because a given flux saturation of the spring does not vary with movement of the counterweight assembly (i.e. changing widths of the axial air gaps), once the amount of expected static magnetic flux is determined, the spring can be designed to account for the static magnetic flux, with the knowledge that the expected static magnetic flux will not vary with respect to operational extremes of the transducer. Put another way, the static magnetic flux generated by the permanent magnets is constant. It is the fact that the path has variables that vary with operation of the transducer (i.e., the air gaps) that impart uncertainty into expected static magnetic flux values. By replacing at least some of the air gaps with the springs, this uncertainty is reduced. That is, the amount of static magnetic flux that a given spring of a given geometry can accept and still enable the transducer to operate in a utilitarian manner is fixed. It does not change with operation of the transducer. Accordingly, any need to address this "uncertainty" during the design process is not present with respect to transducers utilizing springs to close the static magnetic flux. Additionally, without being bound by theory, by saturating the springs with static magnetic flux, dynamic magnetic flux is less likely to travel therethrough, and this it is more likely to retained sandwiched between the springs.

Moreover, the use of springs as conduits of the static magnetic flux avoid the possibility of "air gap collapse" because there is no air gaps to collapse. In this regard, the magnetic reluctance through a spring is generally constant, and, in contrast, the reluctance across an air gap varies with the width of the air gap. Still further, with respect to radial air gaps that have widths that do not vary, there is still a change in the reluctance across such gaps (e.g., due to imperfections in the alignment of the counterweight assembly and the bobbin assembly, movement away from the alignment during movement of the counterweight assembly upward and/or downward relative to the bobbin assembly, etc.). Accordingly, the reluctance across a spring does not change as much as the change reluctance across even a radial air gap.

In some exemplary embodiments, the effective spring thickness and/or the effective spring radius are varied during design so as to obtain utilitarian spring stiffnesses and utilitarian spring magnetic flux property. By effective spring thickness, it is meant the thickness of a cross-section of the flexible portion of the spring lying on a plane parallel to and lying on the longitudinal axis of the actuator (i.e., the axis aligned with the direction of movement of the bobbin assembly (counterweight assembly) relative to the bobbin assembly). By effective spring radius, it is meant the distance from the longitudinal axis to the location at which the spring contacts structure of the bobbin/counterweight assembly (where it no longer flexes), adjusted for the fact that the area around the longitudinal axis does not flex (due to, for example, the coupling 640 and/or the yoke 1160). That is, the term "effective" addresses the fact that there are portions of the spring that are present but do not flex during energizement of the actuator. By varying the effective spring thickness and the effective spring radius, a wide range of spring stiffnesses can be achieved for a wide range of magnetic fluxes that travel through the spring. In this regard, if a spring thickness of, for example 0.3 mm is utilitarian to achieve a utilitarian magnetic flux therethrough, the effective radius of the spring can be varied (e.g., by varying the distance of the flexible section 1190 during design to obtain a utilitarian spring stiffness for that thickness without substantially impacting the utilitarian nature of the magnetic flux, and visa-versa.

It is noted at this time that in an exemplary embodiment, the thicknesses of the springs of the embodiments detailed herein and/or variations thereof can be about 0.05 mm, 0.1 mm, 0.15 mm, 0.2 mm, 0.25 mm, 0.3 mm, 0.35 mm or about 0.4 mm or any value or range of values between these values in 0.01 mm increments (e.g., about 0.22 mm, about 0.17 mm to about 0.33 mm, etc.). Any spring thickness that can enable the teachings detailed herein and or variations thereof to be practiced can be utilized in some embodiments. Further in this regard any spring geometry can be utilized as well. Along these lines, while a spring having a circular circumference has been the focus of the embodiments detailed herein, springs having a square circumference, a rectangular circumference, or an oval circumference etc., can be utilized in some embodiments.

It is noted that in an exemplary embodiment, the diameters of the electromagnetic transducers according to the embodiments herein and/or variations thereof can be about 8 mm with respect to the balance transducers and about 11 mm with respect to the unbalanced transducers. In some exemplary embodiments, the diameters of the electromagnetic transducers can be about 6 mm, 7 mm, 8 mm, 9 mm, 10 mm, 11 mm, 12 mm or about 13 mm in length and/or a length of any value or range of values therebetween in about 0.1 mm increments (e.g., about 7.8 mm, 6.7 mm to about 11.2 mm, etc.).

It further noted that in an exemplary embodiment, the seismic mass of the transducers detailed herein and or variations thereof, totals about 6 g, and the amount of that mass made up by the permanent magnets corresponds to about 0.3 g. By seismic mass, it is meant the mass of the components that move relative to the portions of the transducer that are fixed to the much more massive object into which were from which the vibrations travel. Accordingly in an exemplary embodiment, the ratio of the mass of the permanent magnets to the total seismic mass of the transducer is about 0.01, 0.02, 0.03, 0.04, 0.05, 0.06, 0.07, 0.08, 0.09, or about 0.10 or any value or range of values therebetween in about 0.002 increments (e.g., about 0.053, about 0.041 to about 0.064, etc.).

Without being bound by theory, in an exemplary embodiment, utilization of the springs as a conduit for the magnetic flux enables the permanent magnets to be made smaller, as the flux generated by those permanent magnets is more efficiently conducted through the components of the transducer. In this regard, air gaps present a feature that frustrates, to an extent, the efficient conduction of the flux through the transducer. The elimination of the air gaps by replacement thereof by the springs enables smaller (e.g., less powerful magnets to be used) as compared to the transducer that utilizes air gaps instead of springs to close the magnetic field, all other things being.

An exemplary embodiment includes placing holes through one or more or all of the springs of the actuator to "fine-tune" the stiffness and/or magnetic flux properties of the spring(s). Accordingly, an exemplary embodiment includes springs having holes (circular, oval, arcuate etc.) therethrough. Some embodiments of these exemplary embodiments include through holes while other embodiments of these exemplary embodiments include tools that do not pass all the way through the spring. Accordingly by varying the depth of these holes, the stiffness and/or magnetic flux properties can be further fine-tuned. It is therefore noted that a method of manufacture of the actuators detailed herein and/or variations thereof includes fine-tuning the stiffness and/or magnetic flux properties of a spring along these lines.

In at least some exemplary embodiments, the actuators in general, and the springs in particular, are configured such that during all operating conditions (e.g., such as those conditions pertaining to the operation of a bone conduction device to talk a hearing percept), the springs remain magnetically saturated. In an exemplary embodiment, this enables the magnetic flux passing through the springs to be substantially if not completely independent of the respective magnetic field. Accordingly, an exemplary embodiment is such that the magnetic flux through the springs does not substantially vary with variations in the axial air gap size during operation (e.g., during utilization of the actuator in a bone conduction device to invoke a hearing percept). In an exemplary embodiment, this provides utility in that the risk of air gap collapse is reduced as compared to actuators that do not have such features, where air gap collapse can occur when the magnetic force is stronger than the restoring mechanical spring force.

In an exemplary embodiment, the spring is made out of materials that have a relatively high yield strength or otherwise can withstand the stresses exposed to the spring during normal operation of the vibrating actuators (e.g. such as utilization of the actuators in a bone conduction device to invoke a hearing percept), and also a relatively high magnetic induction. By way of example only and not by way of limitation, materials having yield stresses of about 400, 450, 475, 500, 515, 525, 530, 535, 540, 545, 550, 555, 560, 565, 570, 575, 580, 600, 625, 650 and/or about 700 MPa and or any value or range of values therebetween in at least 0.1 MPa increments (e.g., 523.7 MPa, 515-585 MPa, etc.) can be used for the spring. Also by way of example only and not by way of limitation, materials having magnetic flux saturation of about 0.5 T, 0.6 T, 0.7 T, 0.8 T, 0.9 T, 1.0 T, 1.1 T, 1.2 T, 1.3 T, 1.4 T, 1.5 T, 1.6 T, 1.7 T, 1.8 T, 1.9 T, 2.0 T, 2.1 T, 2.2 T, 2.3 T, 2.4 T and/or 2.5 T and/or any value or range of values therebetween in at least 0.01 T increments can be used for the spring. An exemplary material is Hiperco® Alloy 27.

It is noted that in some embodiments, the static flux through the springs 656 and/or 657 is substantially constant (including constant) through the range of movements of the counterweight assembly 655 relative to the bobbin assembly 654. Without being bound by theory, it is believed that this is due to magnetic flux saturation, where by limiting the flux density, the magnetic force is correspondingly limited. This can prevent and/or otherwise reduce the risk of axial air gap collapse relative to a transducer utilizing air gaps to close the static magnetic flux, all other things being equal.

In an exemplary embodiment, the springs are configured and dimensioned such that the reluctance across one spring is effectively the same as the reluctance across the other spring through the range of movements of the counterweight assembly relative to the bobbin assembly. In an exemplary embodiment utilizing a spring and a radial air gap (e.g., according to the embodiment of FIG. 10), the spring and the radial air gap are configured and dimensioned such that the reluctance across the spring is effectively the same as the reluctance across the air gap through the range of movements of the counterweight assembly relative to the bobbin assembly. Accordingly, to the extent that reluctance varies in some embodiments, in some embodiments, as reluctance varies in one spring, the reluctance will vary in the same way at the other spring. Also accordingly, to the extent that reluctance varies in some embodiments, in some embodiments, as reluctance varies in one spring, the reluctance will vary in the same way at the radial air gap, and visa-versa.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A balanced electromagnetic transducer, comprising:

first and second components connected together by a flexible component, at least a part of the flexible component flexes upon exposure of the transducer to energy, wherein the transducer is configured to generate static magnetic flux that passes from the first component to the second component via the flexible component and that travels across no more than two air gaps, wherein the balanced electromagnetic transducer is an actuator;

the balanced electromagnetic transducer is configured to generate a dynamic magnetic flux, and the balanced electromagnetic transducer is configured such that the static magnetic flux and the dynamic magnetic flux interact across two air gaps, both of which have a span that varies during actuation of the actuator, thereby actuating the actuator.

2. The balanced electromagnetic transducer of claim 1, wherein:

the first component is configured to generate the static magnetic flux; and the electromagnetic transducer is configured such that the generated static magnetic flux travels through only one contiguous yoke apparatus while traveling through the first component.

3. The balanced electromagnetic transducer of claim 1, wherein:

the generated static magnetic flux includes a closed static magnetic flux path, the balanced electromagnetic transducer being configured such that the closed path travels across no more than one air gap.

4. The balanced electromagnetic transducer of claim 1, further comprising:

at least one permanent magnet positioned directly in contact with the flexible component.

5. The balanced electromagnetic transducer of claim 1, wherein:

the generated static magnetic flux includes a closed static magnetic flux path, the closed path traveling through a group of components comprising:

a permanent magnet;

a first yoke;

an axial air gap;

a second yoke; and the flexible component.

6. The balanced electromagnetic transducer of claim 5, wherein the group of components further comprises:

a third yoke adjacent to the permanent magnet and the flexible component and interposed between the permanent magnet and the flexible component.

7. The balanced electromagnetic transducer of claim 5, wherein the group of components consists of:

the permanent magnet;

the first yoke;

the axial air gap;

the second yoke; and the flexible component.

8. A prosthesis, comprising:

a bone conduction device including the balanced electromagnetic transducer of claim 1.

9. The prosthesis of claim 8, wherein:

the first component includes a yoke and at least two permanent magnets located on opposite sides of the yoke; and the second component includes a bobbin and a coil wound about the bobbin.

10. The prosthesis of claim 9, wherein:

at least a portion of the yoke is interposed between arms of the bobbin; and the balanced electromagnetic transducer includes two flexible components, wherein the two flexible components respectively extend from the two permanent magnets to the bobbin.

11. A method of transducing energy, comprising:

moving a first assembly relative to a second assembly in an oscillatory manner, wherein during the movement, there is interaction of a dynamic magnetic flux and a static magnetic flux; and directing the static magnetic flux along a closed circuit that extends across more than one air gap, all of the more than one air gaps having respective widths that vary while the static magnetic flux is so directed and interacting with the dynamic magnetic flux, wherein:

a rate of change of variation of width of one of the air gaps of the closed circuit is different from that of at least one of the other air gaps of the closed circuit.

12. The method of claim 11, wherein:

the closed circuit extends across only one air gap.

13. The method of claim 11, wherein:

the static magnetic flux includes one or more local flux circuits, and the number of air gaps crossed by the static magnetic flux equals the number of local flux circuits.

14. The method of claim 11, further comprising the action of:

saturating a flexible solid body with the static magnetic flux.

15. A method of evoking a hearing percept, comprising:

receiving a sound signal; and generating vibrations based on the received sound signal via the method of claim 11.

16. The balanced electromagnetic transducer of claim 1, wherein:

the generated static magnetic flux includes a closed static magnetic flux path, the balanced electromagnetic transducer being configured such that the closed path travels across only one air gap.

17. The balanced electromagnetic transducer of claim 1, wherein:

the generated static magnetic flux travels across only two air gaps.

18. The balanced electromagnetic transducer of claim 1, wherein:

the balanced electromagnetic transducer is an actuator;

the balanced electromagnetic transducer is configured to generate a dynamic magnetic flux; and the balanced electromagnetic transducer is configured such that the static magnetic flux and the dynamic magnetic flux interact across at least one air gap, thereby actuating the actuator.

19. The balanced electromagnetic transducer of claim 1, including:

at least one axial air gap.

20. The balanced electromagnetic transducer of claim 1, including:

two axial air gaps.

* * * * *